US009903623B2

(12) United States Patent
Kawano et al.

(10) Patent No.: US 9,903,623 B2
(45) Date of Patent: Feb. 27, 2018

(54) EJECTOR HAVING AN ATOMIZATION MECHANISM AND HEAT PUMP APPARATUS

(71) Applicant: Panasonic Intellectual Property Management Co., Ltd., Osaka (JP)

(72) Inventors: Bunki Kawano, Osaka (JP); Tomoichiro Tamura, Kyoto (JP); Takahiro Matsuura, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 288 days.

(21) Appl. No.: 14/990,786

(22) Filed: Jan. 7, 2016

(65) Prior Publication Data

US 2016/0216016 A1 Jul. 28, 2016

(30) Foreign Application Priority Data

Jan. 22, 2015 (JP) ..... 2015-010169

(51) Int. Cl.

| | |
|---|---|
| ***F25B 41/06*** | (2006.01) |
| ***B05B 7/06*** | (2006.01) |
| ***F25B 40/00*** | (2006.01) |
| ***F25B 1/06*** | (2006.01) |

(52) U.S. Cl.

CPC ..... *F25B 41/06* (2013.01); *B05B 7/061* (2013.01); *F25B 1/06* (2013.01); *F25B 40/00* (2013.01); *F25B 2500/01* (2013.01)

(58) Field of Classification Search

CPC ..... F25B 1/06; F25B 9/08; F25B 2341/001

See application file for complete search history.

(56) References Cited

U.S. PATENT DOCUMENTS 8,006,961 B1 * 8/2011 Rutstein ..... F04F 5/16 239/DIG. 7

FOREIGN PATENT DOCUMENTS

JP 6-002964 1/1994

* cited by examiner

*Primary Examiner* — Cassey D Bauer

(74) *Attorney, Agent, or Firm* — McDermott Will & Emery LLP

(57) ABSTRACT

An ejector includes an atomization mechanism arranged at an end of a first nozzle. The atomization mechanism includes a plurality of orifices and a collision plate against which each of a plurality of jets ejected from the plurality of orifices collides. The collision plate includes a first principal surface and a second principal surface as a collision surface against which the jet collides, each of the first principal surface and the second principal surface extending toward an outlet of the ejector. The plurality of orifices includes a plurality of first orifices arranged on a side of the first principal surface of the collision plate and a plurality of second orifices arranged on a side of the second principal surface of the collision plate.

19 Claims, 17 Drawing Sheets

EJECTOR HAVING AN ATOMIZATION MECHANISM AND HEAT PUMP APPARATUS

BACKGROUND

1. Technical Field

The present disclosure relates to an ejector to which single-fluid atomization techniques are applied and a heat pump apparatus that uses the ejector.

2. Description of the Related Art

Atomization techniques are applied in various industrial fields, which include spray coating, spray drying, humidity control, agrochemical dispersion, and fire extinguishing, in addition to energy-related techniques, such as combustion techniques for liquid fuel. Performances desired for spray nozzles vary, depending on the application purposes of the spray nozzles. The atomization principle of a spray nozzle is variously studied, such as atomization using a turbulent flow, atomization including film thinning by widening a sprayed area, atomization using centrifugal force, or atomization using two-fluid interaction. However, a nozzle that can achieve a high flow rate, high performance in atomization, a high spray speed, a small spray angle, and flow contraction spraying at the same time through the application of the principle of single-fluid atomization has not existed.

An ejector is used for various apparatuses as a pressure reducer, which include a vacuum pump and a refrigeration cycle apparatus. As illustrated in FIG. 18, a refrigeration cycle apparatus 300 described in Japanese Patent No. 3158656 includes a compressor 102, a condenser 103, an ejector 104, a separator 105, and an evaporator 106. The ejector 104 receives refrigerant liquid from the condenser 103 as a driving flow and sucks refrigerant vapor supplied from the evaporator 106 and boosts the pressure of the refrigerant vapor before discharging the resultant refrigerant to the separator 105. The separator 105 separates the refrigerant liquid and the refrigerant vapor. The compressor 102 sucks the refrigerant vapor having the pressure that has been boosted by the ejector 104. Thus, the compression work of the compressor 102 is reduced and the coefficient of performance (COP) of the refrigeration cycle is increased.

As illustrated in FIG. 19, the ejector 104 includes a nozzle 140, a suction port 141, a mixer 142, and a pressure booster 143. Near the outlet of the nozzle 140, a plurality of communication ports 144 for communication between the inside and the outside of the nozzle 140 are provided. The refrigerant vapor is sucked into the ejector 104 from the suction port 141. Part of the sucked refrigerant vapor is guided into the inside of the nozzle 140 through the communication ports 144.

The nozzle 140 of the ejector 104 includes a diameter reduction portion near the outlet of the nozzle 140. In the diameter reduction portion, the flow velocity of the refrigerant increases and the pressure decreases. As a result, the refrigerant supplied to the nozzle 140 as the driving flow changes into a gas-liquid two-phase state from the liquid-phase state in the diameter reduction portion. That is, the ejector 104 illustrated in FIG. 19 is called a two-phase flow ejector.

SUMMARY

One non-limiting and exemplary embodiment provides single-fluid atomization techniques of liquid to increase the performance of an ejector, which depends on whether the momentum is efficiently transported between a driving flow and a suction flow.

In one general aspect, the techniques disclosed here feature an ejector including: a first nozzle to which a liquid-phase working fluid is supplied; a second nozzle into which a vapor-phase working fluid is sucked; an atomization mechanism that is arranged at an end of the first nozzle and atomizes the liquid-phase working fluid without changing a liquid-phase state of the liquid-phase working fluid; and a mixer that mixes the atomized working fluid generated in the atomization mechanism and the vapor-phase working fluid sucked into the second nozzle and generates a fluid mixture, the atomization mechanism including a plurality of orifices and a collision plate against which each of a plurality of jets ejected from the plurality of orifices collides, the collision plate including a first principal surface and a second principal surface as a collision surface against which the jet collides, each of the first principal surface and the second principal surface extending toward an outlet of the ejector, the plurality of orifices including a plurality of first orifices arranged on a side of the first principal surface of the collision plate and a plurality of second orifices arranged on a side of the second principal surface of the collision plate.

The techniques according to the present disclosure may enable the momentum of the liquid-phase working fluid, which is the driving flow, to be efficiently transported into the vapor-phase working fluid, which is the suction flow. Thus, the performance of the ejector increases.

It should be noted that general or specific embodiments may be implemented as a system, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
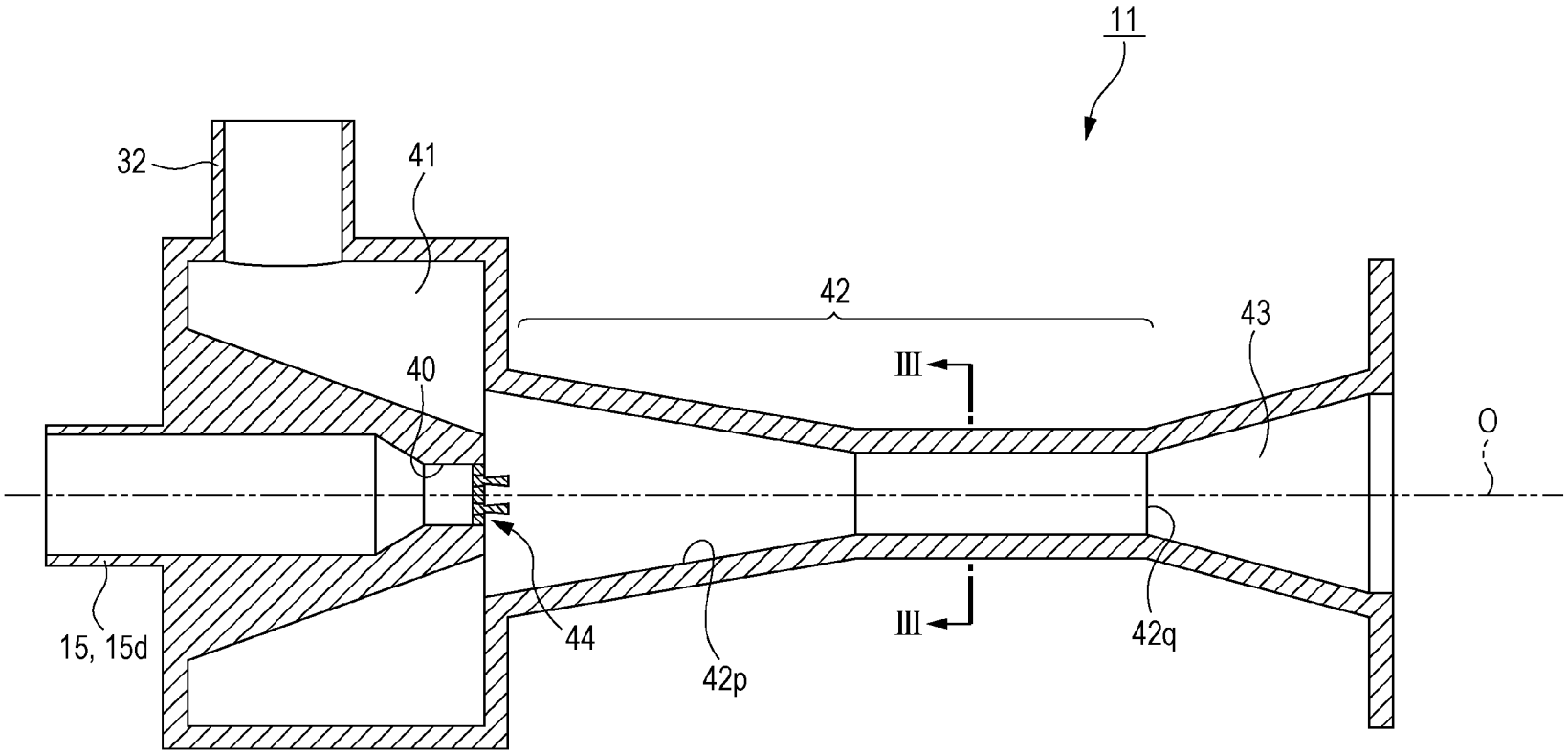
FIG. 1 is a cross-sectional view of an ejector according to Embodiment 1 of the present disclosure.

When a driving flow is gas or a two-phase flow with high void fraction while a suction flow is gas, the momentum can be efficiently transported between the driving flow and the suction flow simply by mixing the driving flow and the suction flow. In contrast, when the driving flow is liquid while the suction flow is gas, the time taken to relax the velocity, which is the time taken for the velocity of the driving flow and the velocity of the suction flow to become approximately equal, is long and thus, the transportation of the momentum from the driving flow to the suction flow is hindered. As a result, it is difficult to expect high-efficiency driving of the ejector.

When the driving flow is liquid while the suction flow is gas, a mixing chamber of the ejector is filled with a two-phase flow. A principal factor in the transportation of the momentum from the driving flow to the suction flow is spray resistance, which is caused by viscous resistance for example. When liquid is ejected into the mixing chamber filled with gas, a gas-liquid two-phase spray flow where droplets constitute a dispersed phase and gas constitutes a continuous phase is formed. In the two-phase flow where the dispersed phase and the continuous phase have relative velocity, the transportation of the momentum is ruled by the equation of motion of a droplet. According to the equation of motion of a droplet, as the contact area between the droplet and the gas increases, the transportation of the momentum can proceed in reduced time. That is, under the constraint that the size of the ejector is limited, as the total surface area of the droplets increases (as the diameter of each droplet decreases), the transportation of the momentum can proceed more efficiently.

When the sprayed driving flow (the spray flow) collides against the inner wall surface of the ejector, the performance of the ejector is reduced by decrease in the surface area, which is due to the coalescence of a plurality of droplets, and by consumption of the momentum as force. Also when the droplets collide against one another, the particle diameter increases because of the coalescence of the plurality of droplets. As a result, the total surface area of the droplets decreases and the performance of the ejector is reduced. Besides, also when drip occurs in a mechanism for ejecting the driving flow, the total surface area of the droplets decreases and the performance of the ejector is reduced.

On the basis of the above-described findings, the present inventors have conceived the techniques for suppressing collision of a droplet against the inner wall surface of an ejector, coalescence of droplets, and drip in a mechanism for ejecting a driving flow.

A first aspect of the present disclosure provides an ejector including:

- a first nozzle to which a liquid-phase working fluid is supplied;
- a second nozzle into which a vapor-phase working fluid is sucked;
- an atomization mechanism that is arranged at an end of the first nozzle and atomizes the liquid-phase working fluid without changing a liquid-phase state of the liquid-phase working fluid; and
- a mixer that mixes the atomized working fluid generated in the atomization mechanism and the vapor-phase working fluid sucked into the second nozzle and generates a fluid mixture,
- the atomization mechanism including a plurality of orifices and a collision plate against which each of a plurality of jets ejected from the plurality of orifices collides,
- the collision plate including a first principal surface and a second principal surface as a collision surface against which the jet collides, each of the first principal surface and the second principal surface extending toward an outlet of the ejector,
- the plurality of orifices including a plurality of first orifices arranged on a side of the first principal surface of the collision plate and a plurality of second orifices arranged on a side of the second principal surface of the collision plate.

According to the first aspect, the jets ejected from the orifices collide against the collision plate and a thin liquid film is generated. The liquid film is unstable, quickly atomized, and supplied to the mixer. In the mixer, the atomized working fluid is mixed with the vapor-phase working fluid and the fluid mixture is generated. The fluid mixture has a form of a fine spray flow. The contact area between the liquid-phase working fluid and the vapor-phase working fluid is increased by atomizing the liquid-phase working fluid. In the liquid film generated through the collision of the jets against the collision plate, the flow velocity in close proximity to a surface of the collision plate is low. The flow with the low flow velocity and the flow with the flow velocity that is reduced by a hydraulic jump phenomenon move around an end surface of the collision plate because of the surface tension of the liquid. According to the first aspect of the present disclosure, jets are caused to collide against the first principal surface and the second principal surface of the collision plate and thus, drip that can possibly occur on the end surface of the collision plate can be suppressed. Consequently, in the ejector according to the first aspect, the momentum of the liquid-phase working fluid, which is the driving flow, can be efficiently transported to the vapor-phase working fluid, which is the suction flow. That is, the present disclosure can provide an ejector with high performance.

In addition to the first aspect, a second aspect of the present disclosure provides the ejector, where, in a cross section including a central axis of the ejector, (a) an extension line of the first principal surface of the collision plate intersects an inner wall surface of the mixer, or (b) when, on an opening plane on an outlet side of the mixer, r represents a distance from the central axis of the ejector to the inner wall surface of the mixer, an intersection point of the extension line of the first principal surface of the collision plate and the opening plane on the outlet side of the mixer is in a range from a boundary between the opening plane on the outlet side of the mixer and the inner wall surface of the mixer to a position away from the boundary by r/4. According to the second aspect, while the spray flow can be uniformly diffused all over the mixer, collision of the spray flow against the inner wall surface of the mixer can be avoided as much as possible. As a result, loss in the momentum and coalescence of a plurality of droplets, which the collision of the spray flow against the inner wall surface of the mixer causes, can be suppressed and the efficiency of the ejector can be enhanced.

In addition to the first or second aspect, a third aspect of the present disclosure provides the ejector, where the atomization mechanism includes a plurality of collision plates, each of which is the collision plate. The third aspect facilitates coping with increase in the flow rate of the ejector.

In addition to the second aspect, a fourth aspect of the present disclosure provides the ejector, where a plurality of collision plates, each of which is the collision plate, are provided in a direction from the central axis of the ejector toward the inner wall surface of the mixer, and in the collision plate arranged in a position closest to the inner wall surface of the mixer, the first principal surface is positioned nearer to the inner wall surface of the mixer than the second principal surface is, and the (a) or the (b) is satisfied. According to the above-described configuration, the advantages described with the second aspect can be obtained even when the plurality of collision plates are provided.

In addition to any one of the first to fourth aspects, a fifth aspect of the present disclosure provides the ejector, where, when the atomization mechanism is viewed from a side of the outlet of the ejector as a plane, the plurality of first orifices are arranged on a first virtual circle and the plurality of second orifices are arranged on a second virtual circle concentric with the first virtual circle. According to the above-described arrangement, drip caused by the quid-phase working fluid moving around can be sufficiently suppressed.

In addition to any one of the first to fifth aspects, a sixth aspect of the present disclosure provides the ejector, where the first principal surface and the second principal surface of the collision plate are each a conical surface or a cylindrical surface. The collision plate shaped as described above enables the spray flow to be uniformly supplied toward the mixer.

In addition to any one of the first to fourth aspects, a seventh aspect of the present disclosure provides the ejector, where a plurality of collision plates, each of which is the collision plate, are provided in a direction from the central axis of the ejector toward the inner wall surface of the mixer, when the atomization mechanism is viewed from a side of the outlet of the ejector as a plane, the plurality of orifices are arranged on a plurality of virtual circles concentric with each other, and each of the collision plates is arranged between the virtual circles next to each other. The seventh aspect facilitates coping with increase in the flow rate of the ejector.

In addition to the seventh aspect, an eighth aspect of the present disclosure provides the ejector, where the first principal surface and the second principal surface of the collision plate are each a conical surface or a cylindrical surface, the conical surface or the cylindrical surface being concentric with the plurality of virtual circles. The collision plate shaped as described above enables the spray flow to be uniformly supplied toward the mixer.

In addition to any one of the first to fourth aspects, a ninth aspect of the present disclosure provides the ejector, where, when the atomization mechanism is viewed from a side of the outlet of the ejector as a plane, the plurality of first orifices are arranged on a first virtual straight line and the plurality of second orifices are arranged on a second virtual straight line parallel to the first virtual straight line. According to the above-described arrangement, drip caused by the liquid-phase working fluid moving around can be sufficiently suppressed.

In addition to any one of the first to fourth aspects, a tenth aspect of the present disclosure provides the ejector, where the atomization mechanism includes a plurality of collision plates, each of which is the collision plate, when the atomization mechanism is viewed from the outlet side of the mixer as a plane, the plurality of orifices are arranged on a plurality of virtual straight lines parallel to each other, and each of the collision plates is arranged between the virtual straight lines next to each other. The tenth aspect facilitates coping with increase in the flow rate of the ejector.

In addition to any one of the first to eighth aspects, an eleventh aspect of the present disclosure provides the ejector, where, in a cross section perpendicular to the central axis of the ejector, the inner wall surface of the mixer indicates a circle. Since the cross-sectional shape of the mixer is in similitude relation with the arrangement of the orifices in the atomization mechanism, in other words, the cross-sectional shape of the mixer is in similitude relation with the diffusion pattern of the spray flow, the volumetric efficiency of the ejector can be enhanced.

In addition to any one of the first, ninth, and tenth aspects, a twelfth aspect of the present disclosure provides the ejector, where, in a cross section perpendicular to a central axis of the ejector, the inner wall surface of the mixer indicates a polygon. Since the cross-sectional shape of the mixer is in similitude relation with the arrangement of the orifices in the atomization mechanism, in other words, the cross-sectional shape of the mixer is in similitude relation with the diffusion pattern of the spray flow, the volumetric efficiency of the ejector can be enhanced.

In addition to any one of the first to twelfth aspects, a thirteenth aspect of the present disclosure provides the ejector, where the plurality of first orifices and the plurality of second orifices are arranged at alternate positions along the collision plate. According to the thirteenth aspect, drip suppression effect can be obtained more sufficiently.

In addition to any one of the first to thirteenth aspects, a fourteenth aspect of the present disclosure provides the ejector further including a diffuser that restores static pressure by reducing velocity of the fluid mixture. Since the velocity of the fluid mixture is reduced in the diffuser, the static pressure of the fluid mixture can be restored.

A fifteenth aspect of the present disclosure provides an ejector including:

a first nozzle to which a liquid-phase working fluid is supplied;

a second nozzle into which a vapor-phase working fluid is sucked;

an atomization mechanism that is arranged at an end of the first nozzle and atomizes the liquid-phase working fluid without changing a liquid-phase state of the liquid-phase working fluid; and a mixer that mixes the atomized working fluid generated in the atomization mechanism and the vapor-phase working fluid sucked into the second nozzle and generates a fluid mixture, the atomization mechanism including a plurality of orifices and a collision plate against which each of a plurality of jets ejected from the plurality of orifices collides, the collision plate including a principal surface as a collision surface against which the jet collides, the principal surface extending toward an outlet of the ejector, where in a cross section including a central axis of the ejector, an extension line of the principal surface of the collision plate intersects an inner wall surface of the mixer, or when, on an opening plane on an outlet side of the mixer, r represents a distance from the central axis of the ejector to the inner wall surface of the mixer, an intersection point of the extension line of the principal surface of the collision plate with the opening plane on the outlet side of the mixer is in a range from a boundary between the opening plane on the outlet side of the mixer and the inner wall surface of the mixer to a position away from the boundary by r/4.

According to the fifteenth aspect, while the spray flow can be uniformly diffused all over the mixer, collision of the spray flow against the inner wall surface of the mixer can be avoided as much as possible. As a result, loss in the momentum and coalescence of a plurality of droplets, which the collision of the spray flow against the inner wall surface of the mixer causes, can be suppressed and the efficiency of the ejector can be enhanced.

A sixteenth aspect of the present disclosure provides a heat pump apparatus including:

a compressor that compresses refrigerant vapor;

a heat exchanger through which refrigerant liquid flows;

the ejector according to claim 1 that generates a refrigerant mixture using the refrigerant vapor compressed in the compressor and the refrigerant liquid that flows out from the heat exchanger;

an extractor that receives the refrigerant mixture from the ejector and extracts the refrigerant liquid from the refrigerant mixture;

a fluid pathway that passes from the extractor and reaches the ejector through the heat exchanger; and an evaporator that stores the refrigerant liquid and generates the refrigerant vapor to be compressed in the compressor by vaporizing the refrigerant liquid.

According to the sixteenth aspect, the refrigerant liquid supplied to the ejector is utilized as the driving flow and the refrigerant vapor from the compressor is caused to be sucked into the ejector. The ejector generates the refrigerant mixture using the refrigerant liquid and the refrigerant vapor. Since the work to be performed by the compressor can be reduced, the compression ratio of the compressor can be largely decreased and the efficiency of the heat pump apparatus, which is equivalent to or higher than that of a conventional heat pump apparatus, can be achieved. In addition, the heat pump apparatus can be made smaller in size.

In addition to the sixteenth aspect, a seventeenth aspect of the present disclosure provides the heat pump apparatus, where pressure of the refrigerant mixture discharged from the ejector is higher than pressure of the refrigerant vapor sucked into the ejector and is lower than pressure of the refrigerant liquid supplied to the ejector. According to the seventeenth aspect, the pressure of the refrigerant can be efficiently boosted.

In addition to the sixteenth or seventeenth aspect, an eighteenth aspect of the present disclosure provides the heat pump apparatus, where saturated vapor pressure of a refrigerant at room temperature is negative pressure.

In addition to any one of the sixteenth to eighteenth aspects, a nineteenth aspect of the present disclosure provides the heat pump apparatus, where the refrigerant includes water as a principal ingredient. The load to the environment caused by the refrigerant whose principal ingredient is water is small.

Embodiments of the present disclosure are described below with reference to the drawings. The present disclosure is not limited to the below-described embodiments.

EMBODIMENT 1

As illustrated in FIG. 1, an ejector 11 includes a first nozzle 40, a second nozzle 41, a mixer 42, a diffuser 43 and an atomization mechanism 44. The diffuser 43 may be omitted. The first nozzle 40 is a tubular part arranged in a central portion of the ejector 11. Refrigerant liquid, which is a liquid-phase working fluid, is supplied to the first nozzle 40 as a driving flow. The second nozzle 41 forms annular space around the first nozzle 40. Refrigerant vapor, which is a vapor-phase working fluid, is sucked into the second nozzle 41, The mixer 42 is a tubular part that communicates with both the first nozzle 40 and the second nozzle 41. The atomization mechanism 44 is arranged at an end of the first nozzle 40 so as to face the mixer 42. The atomization mechanism 44 has a function of atomizing the refrigerant liquid without changing the liquid-phase state of the refrigerant liquid. The atomized refrigerant generated in the atomization mechanism 44 and the refrigerant vapor sucked into the second nozzle 41 are mixed in the mixer 42, and a refrigerant mixture, which is a fluid mixture, is generated. The diffuser 43 is a tubular part that communicates with the mixer 42 and includes an opening for discharging the refrigerant mixture to the outside of the ejector 11. The inside diameter of the diffuser 43 is enlarged gradually from the upstream side toward the downstream side. In the diffuser 43, the velocity of the refrigerant mixture is reduced and thus, the static pressure of the refrigerant mixture is restored. When the diffuser 43 is omitted, the static pressure of the refrigerant mixture is restored in the mixer 42. The first nozzle 40, the second nozzle 41, the mixer 42, the diffuser 43, and the atomization mechanism 44 have a common central axis O.

Figure 2A:
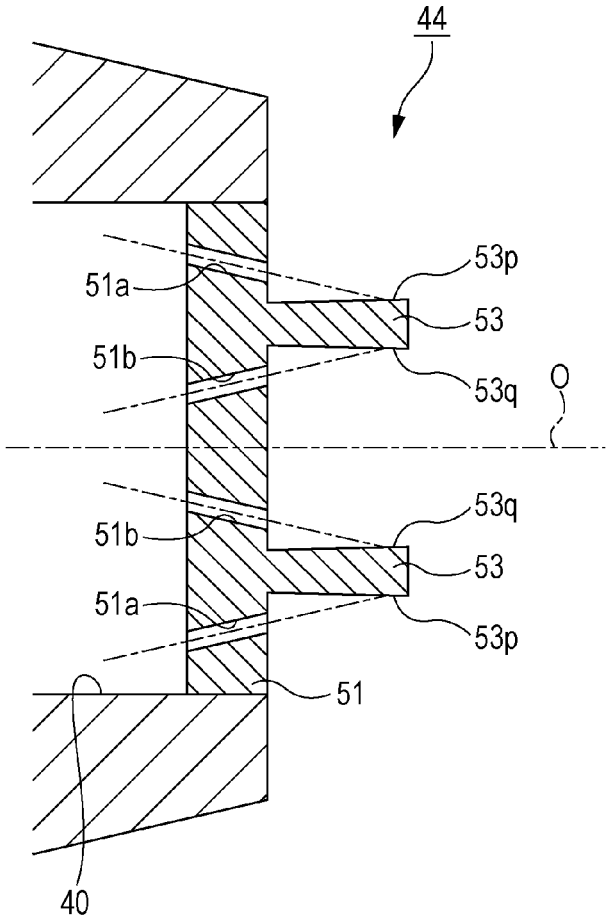
FIG. 2A is a partial enlarged cross-sectional view of an atomization mechanism of the ejector illustrated in FIG. 1.
Figure 2B:
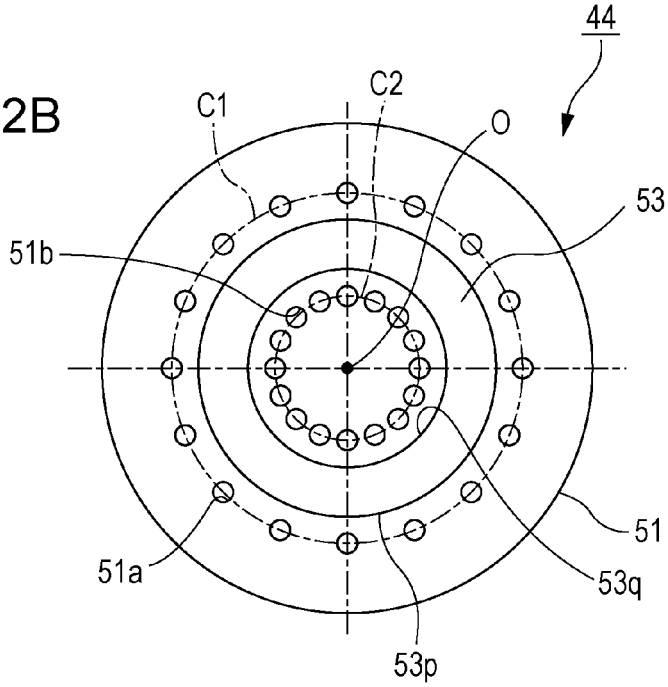
FIG. 2B is a plan view of the atomization mechanism of the ejector illustrated in FIG. 1.

As illustrated in FIGS. 2A and 2B, the atomization mechanism 44 includes an ejection part 51 and a collision plate 53, which is a collision surface formation part. The ejection part 51 is attached at the end of the first nozzle 40. A plurality of orifices 51*a* and 51*b*, which are ejection openings, are formed through the ejection part 51. The plurality of orifices 51*a* and 51*b* penetrate the ejection part 51 so as to allow communication between the first nozzle 40 and the mixer 42. The refrigerant liquid is ejected from the first nozzle 40 to the collision plate 53 through the plurality of orifices 51*a* and 51*b*. That is, the ejection part 51 can generate a jet of the refrigerant liquid. Each of the plurality of jets ejected from the plurality of orifices 51*a* and 51*b* collides against the collision plate 53. Thus, a fine spray flow is generated.

The collision plate 53 includes a first principal surface 53*p* and a second principal surface 53*q* as collision surfaces against which the jets ejected from the ejection part 51 collide. Each of the first principal surface 53*p* and the second principal surface 53*q* extends toward the outlet of the ejector 11. The plurality of orifices 51*a* and 51*b* include the plurality of first orifices 51*a* and the plurality of second orifices 51*b*. The plurality of first orifices 51*a* are arranged on the side of the first principal surface 53*p* of the collision plate 53. The plurality of second orifices 51*b* are arranged on the side of the second principal surface 53*q* of the collision plate 53. The jets ejected from the first orifices 51*a* collide against the first principal surface 53*p* of the collision plate 53. The jets ejected from the second orifices 51*b* collide against the second principal surface 53*q* of the collision plate 53. As described above, the atomization mechanism 44 is structured so that jets collide against two principal surfaces of the collision plate 53. The "principal surface" represents a surface with the largest area.

Figure 4A:
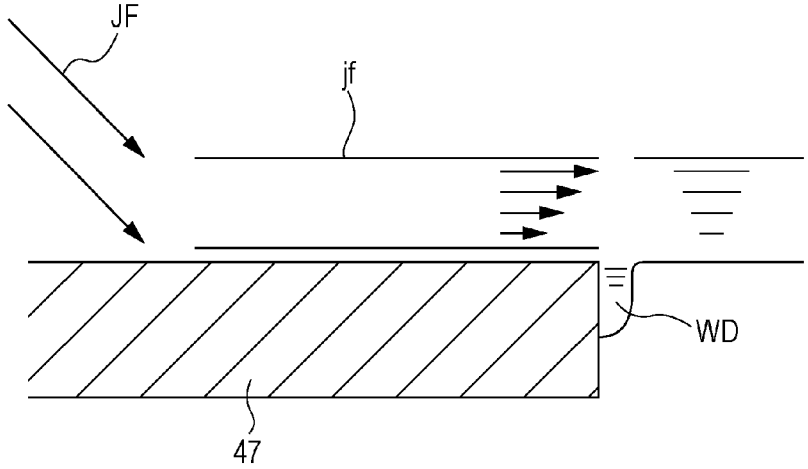
FIG. 4A illustrates what matters when jets are caused to collide against only one surface of a collision plate.

As illustrated in FIG. 4A, when jets JF of the refrigerant liquid are caused to collide against only one surface of a collision plate 47, a jet film jf is formed on the single surface of the collision plate 47. The jet film jf flows along the collision plate 47 and is atomized while issuing from the end of the collision plate 47. At the time, a gradient of the velocity is caused in the jet film jf. That is, the velocity of the jet film jf is low in a position close to the collision plate 47 and high in a position away from the collision plate 47. The difference in the flow velocity and the surface tension allow the refrigerant liquid to move around an end surface of the collision plate 47, and drip WD occurs and drops. The drip WD is one of causes that decrease the performance of the ejector.

Figure 4B:
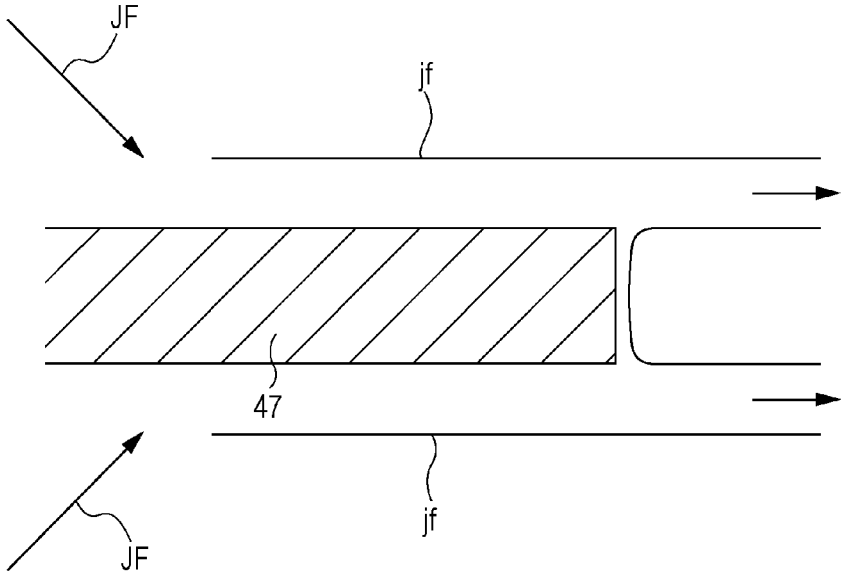
FIG. 4B illustrates advantages obtained when jets are caused to collide against two surfaces of the collision plate.

As illustrated in FIG. 4B, when jets JF of refrigerant liquid are caused to collide against two surfaces of the collision plate 47, the jet film jf is formed on both the two surfaces of the collision plate 47. Also in the example of FIG. 4B, the refrigerant liquid moves around the end surface of the collision plate 47 and drip occurs. However, the drip from one of the two surfaces is involved in the jet film jf on the other surface and atomized. That is, the atomization mechanism 44 according to the present embodiment can efficiently generate a spray flow while suppressing the occurrence of drip.

As illustrated in FIG. 2A, in the present embodiment, the collision plate 53 is a tubular part that extends toward the outlet of the ejector 11 from a surface of the ejection part 51. The first principal surface 53*p* and the second principal surface 53*q* are each a conical surface. Specifically, the first principal surface 53*p* is formed so that the distance from the central axis O to the first principal surface 53*p* increases toward the outlet of the ejector 11. The second principal surface 53*q* is formed so that the distance from the central axis O to the second principal surface 53*q* decreases toward the outlet of the ejector 11. The collision plate 53 shaped as described above enables a spray flow to be uniformly supplied into the mixer 42. The shape of the collision plate is not particularly limited.

As illustrated in FIG. 2A, the central axis of the first orifice 51*a* is inclined with respect to the first principal surface 53*p* of the collision plate 53 and intersects the collision plate 53. The central axis of the second orifice 51*b* is inclined with respect to the second principal surface 53*q* of the collision plate 53 and intersects the collision plate 53. Each of the axis of the first orifice 51*a* and the axis of the second orifice 51*b* may be inclined with respect to an inner wall surface 42*p* of the mixer 42. The opening shape, that is, the cross-sectional shape of each of the orifices 51*a* and 51*b* is not particularly limited. The opening shape of each of the orifices 51*a* and 51*b* is, for example, a circle, an ellipse, or a rectangle. The sizes of the droplets can be made uniform by suitably specifying the shape, the number, the arrangement, and the like of the orifices 51*a* and 51*b*.

As illustrated in FIG. 2B, the plurality of first orifices 51*a* are arranged at equiangular intervals along the first principal surface 53*p* of the collision plate 53. That is, the plurality of first orifices 51*a* are arranged on a first virtual circle C1. Similarly, the plurality of second orifices 51*b* are arranged at equiangular intervals along the second principal surface 53*q* of the collision plate 53. That is, the plurality of second orifices 51*b* are arranged on a second virtual circle C2, which is concentric with the first virtual circle C1. Pairs of the first orifices 51*a* and the second orifices 51*b* are positioned at respective equal angles around the central axis O. The first principal surface 53*p*, which is a conical surface, is concentric with the first virtual circle C1 and the second virtual circle C2. The second principal surface 53*q*, which is a conical surface, is also concentric with the first virtual circle C1 and the second virtual circle C2. According to the above-described arrangement, drip caused by the refrigerant liquid moving around can be sufficiently suppressed. The plurality of first orifices 51*a* are arranged so as to have axial symmetry and the plurality of second orifices 51*b* are arranged so as to have axial symmetry. Accordingly, lack of uniformity in the diameters of the droplets in the spray flow can be suppressed. The number of the first orifices 51*a* may be the same as or different from the number of the second orifices 51*b*.

Figure 3:
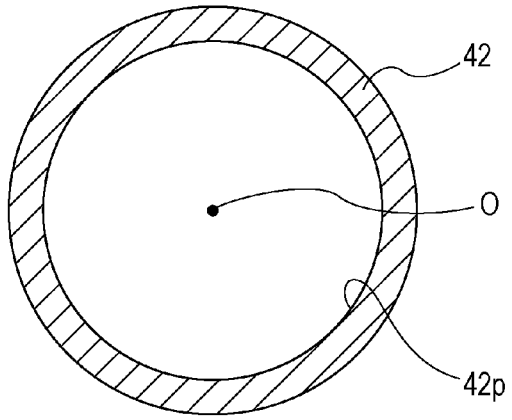
FIG. 3 is a cross-sectional view of a mixer of the ejector illustrated in FIG. 1, which is taken along line III-III.

As illustrated in FIG. 3, in a cross section perpendicular to the central axis O of the ejector 11, the inner wall surface 42*p* of the mixer 42 indicates a circle. In the present embodiment, the first principal surface 53*p* and the second principal surface 53*q*, which are the collision surfaces, are each a conical surface. Accordingly, the spray flow diffuses conically in the mixer 42. Since the cross-sectional shape of the mixer 42 is in similitude relation with the arrangement of the orifices 51*a* and 51*b* in the atomization mechanism 44, in other words, the cross-sectional shape of the mixer 42 is in similitude relation with the diffusion pattern of the spray flow, the volumetric efficiency of the ejector 11 can be enhanced.

In the present embodiment, the mixer 42 is made up of a portion where the cross-sectional area, that is, the inside diameter gradually decreases and a portion where the cross-sectional area or the inside diameter remains unchanged. As described below, only the portion where the cross-sectional area gradually decreases may constitute the mixer 42.

As described above, to enhance the performance of the ejector 11, it is desirable that the spray flow generated in the atomization mechanism 4 be caused to avoid colliding against the inner wall surface 42*p* of the mixer 42 as much as possible. In addition to the inclination of the collision surface positioned farthest from the central axis O, which is the first principal surface 53*p*, the positional relation between the collision surface and the inner wall surface 42*p* of the mixer 42 is important. The present embodiment employs a structure, which is described below.

Figure 5A:
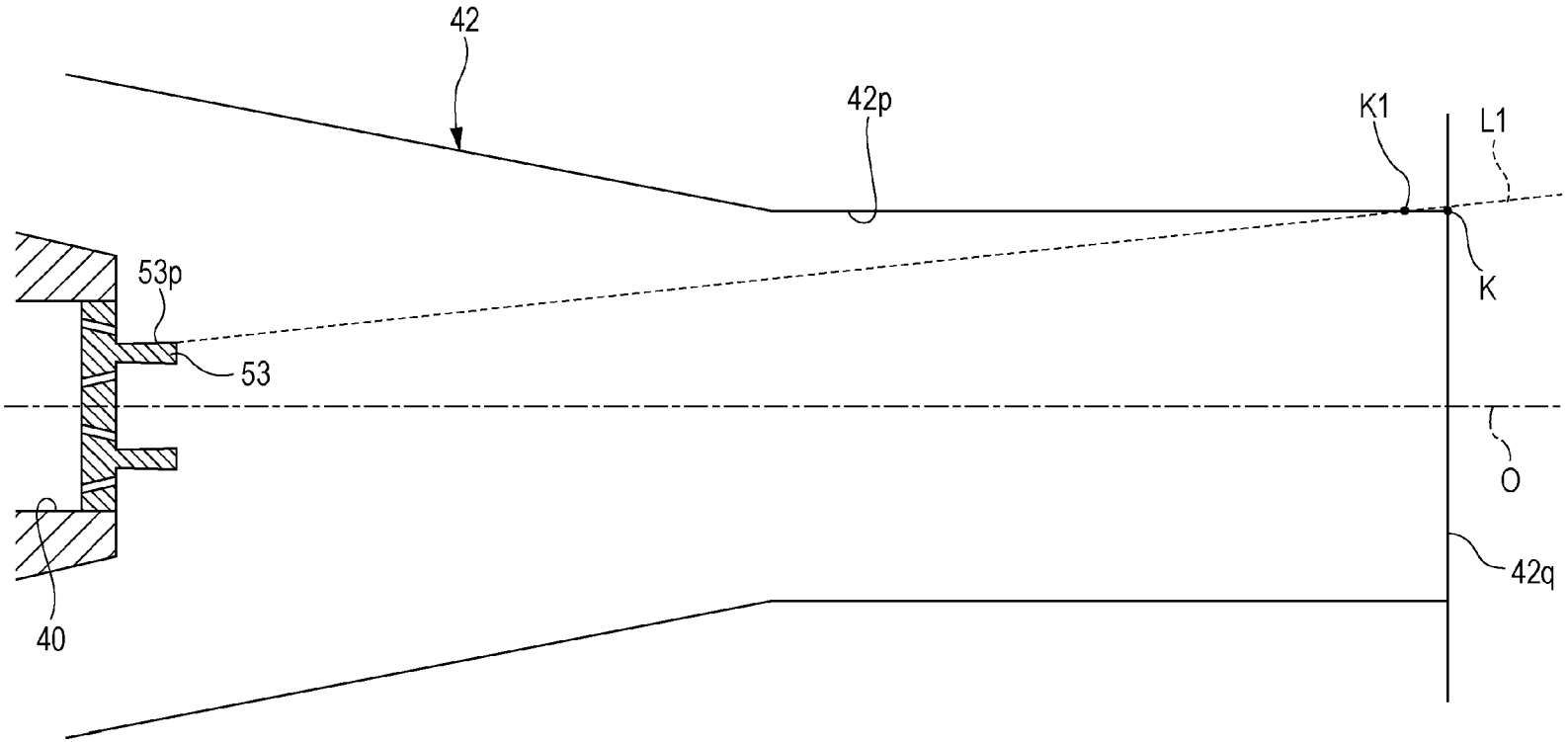
FIG. 5A is a diagram illustrating the positional relation between the collision plate of the atomization mechanism and the inner wall surface of the mixer.

As illustrated in FIG. 5A, in a cross section including the central axis O of the ejector 11, an extension line L1 of the first principal surface 53*p* of the collision plate 53 intersects the inner wall surface 42*p* of the mixer 42. An intersection point K1 of the extension line L1 and the inner wall surface 42*p* is positioned slightly more on the upstream side, compared with the boundary K between an opening plane 42*q* on the outlet side of the mixer 42 and the inner wall surface 42*p* of the mixer 42. The spray flow diffuses slightly more inside than the extension line L1, that is, toward the side closer to the central axis O, because of interference with a liquid pool formed on the end surface of the collision plate 53. Accordingly, the configuration illustrated in FIG. 5A enables the spray flow to avoid colliding against the inner wall surface 42*p* of the mixer 42 as much as possible while the spray flow is uniformly diffused all over the mixer 42. As a result, loss in the momentum and coalescence of a plurality of droplets, which the collision of the spray flow against the inner wall surface 42*p* of the mixer 42 causes, can be suppressed and the efficiency of the ejector 11 can be enhanced.

Figure 5B:
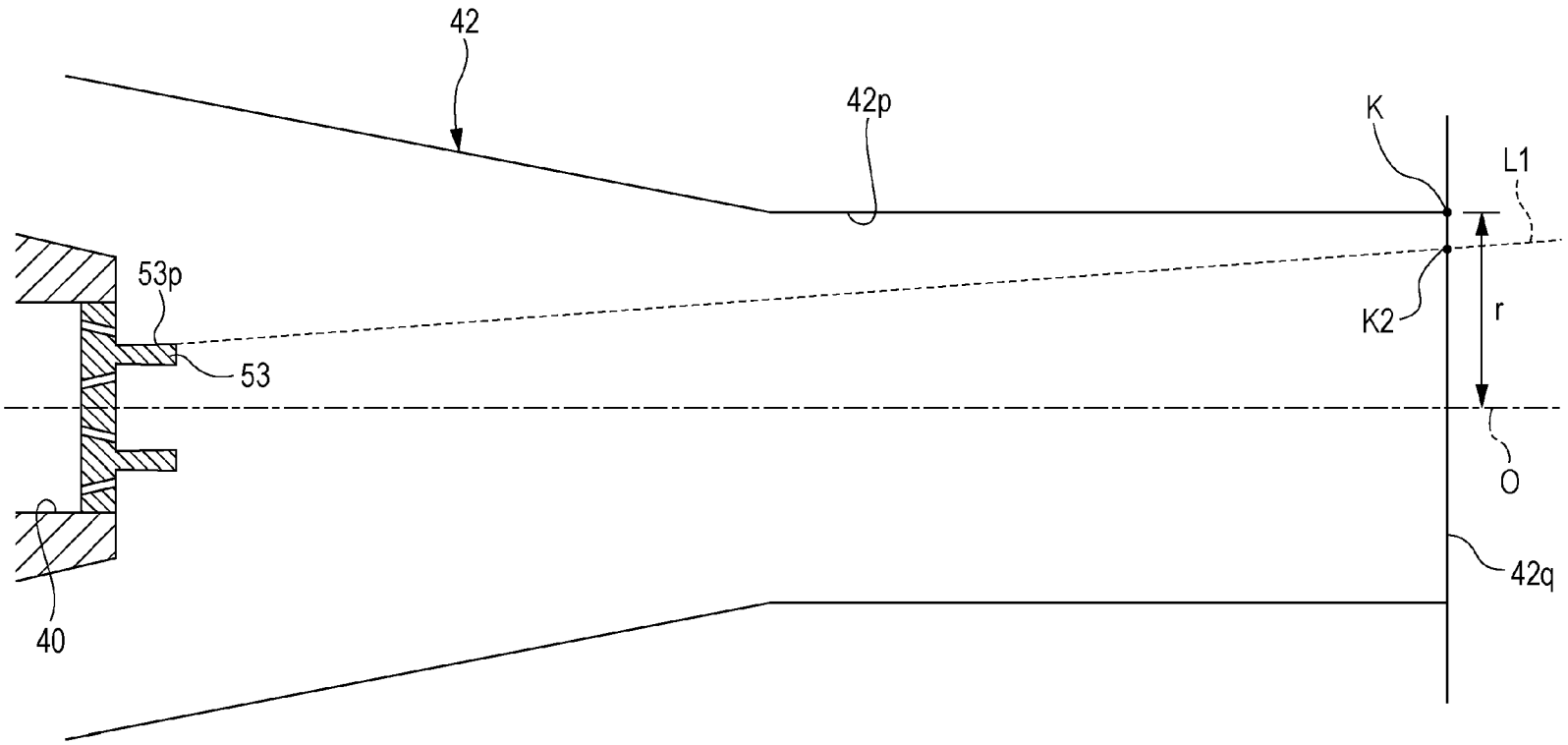
FIG. 5B is another diagram illustrating the positional relation between the collision plate of the atomization mechanism and the inner wall surface of the mixer.

As illustrated in FIG. 5B for another example, in the cross section including the central axis O of the ejector 11, an intersection point K2 of the extension line L1 of the first principal surface 53*p* of the collision plate 53 and the opening plane 42*q* on the outlet side of the mixer 42 is positioned in a range from the boundary K between the opening plane 42*q* on the outlet side of the mixer 42 and the inner wall surface 42*p* of the mixer 42 to a position away from the boundary K by r/4, where, on the opening plane 42*q* on the outlet side of the mixer 42, r represents the distance from the central axis O of the ejector 11 to the inner wall surface 42*p* of the mixer 42. The configuration illustrated in FIG. 5B also enables the spray flow to avoid colliding against the inner wall surface 42*p* of the mixer 42 as much as possible while the spray flow is uniformly diffused all over the mixer 42.

In the cross section including the central axis O of the ejector 11, the extension line L1 of the first principal surface 53*p* of the collision plate 53 may intersect the boundary K. The angle between the extension line L1 that satisfies the condition depicted in FIG. 5A and the inner wall surface 42*p* of the mixer 42 is equal to or smaller than, for example, 10°. The angle between the extension line L1 that satisfies the condition depicted in FIG. 5B and the inner wall surface 42*p* of the mixer 42, which is specifically an extension line of the inner wall surface 42*p*, is equal to or smaller than, for example, 10°.

Figure 6:
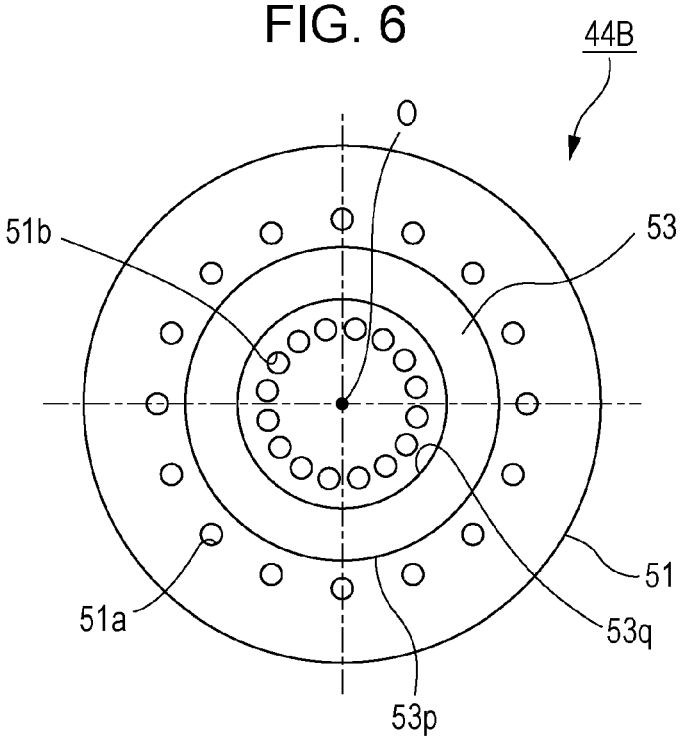
FIG. 6 is a plan view of an atomization mechanism according to a variation.
Figure 7:
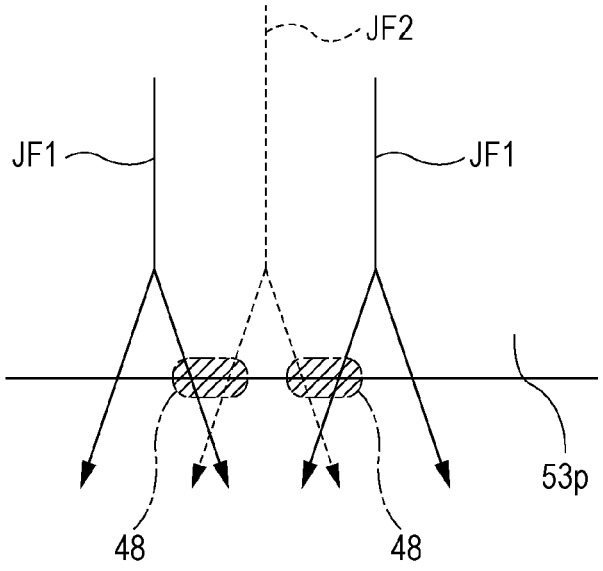
FIG. 7 illustrates advantages obtained by the atomization mechanism illustrated in FIG. 6.

As illustrated in FIG. 6, in an atomization mechanism 44B according to a variation, the first orifices 51*a* and the second orifices 51*b* are arranged at alternate positions along the collision plate 53. In other words, the first orifices 51*a* and the second orifices 51*b* are alternately arranged around the central axis O. As illustrated in FIG. 7, jets JF1 ejected from the first orifices 51*a* collide against the first principal surface 53*p* and a liquid film, which is a spray flow, is formed. At the time, the drip described with reference to FIG. 4A can easily occur on the end surface of the collision plate 53. However, since a liquid film is also present on the second principal surface 53*q* of the collision plate 53, the drip can be suppressed in the present embodiment (see FIG. 4B). The drip can easily occur in regions 48 near both ends of the liquid films. However, when a jet JF2 ejected from the second orifice 51*b* is present between the jets JF1 next to each other, the liquid is unlikely to move in a width direction on the end surface of the collision plate 53. Thus, drip suppression effect can be obtained more sufficiently. When the first orifices 51*a* and the second orifices 51*b* are alternately arranged, confluence of the liquid films can be suppressed by the effect of the dynamic pressure and the surface tension.

Figure 8:
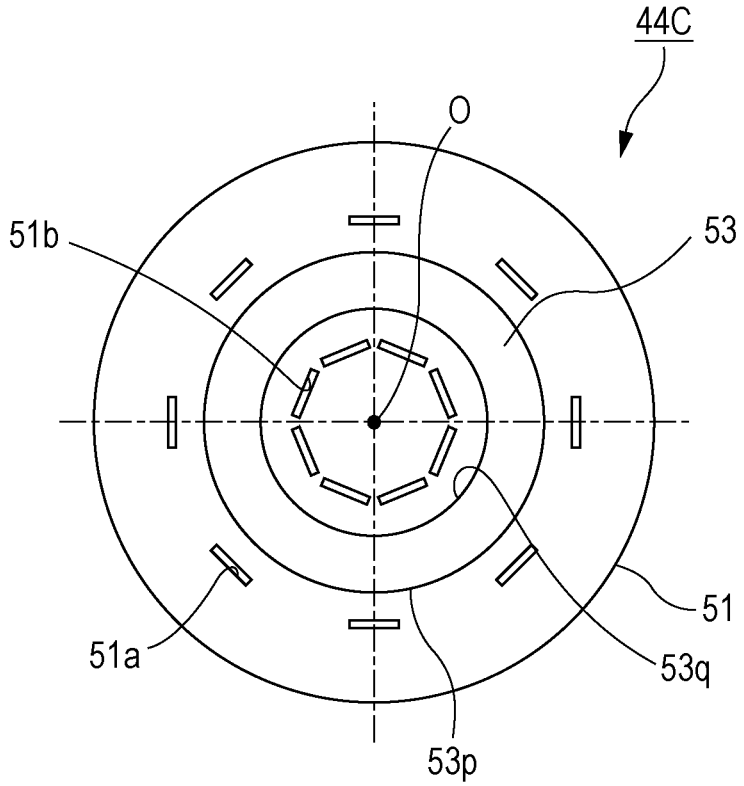
FIG. 8 is a plan view of an atomization mechanism according to another variation.

As illustrated in FIG. 8, in an atomization mechanism 44C according to another variation, the opening shape of each of the orifices 51*a* and 51*b* is a rectangle. That is, the atomization mechanism 44C includes the orifices 51*a* and 51*b* like slits. Also in the present variation, the first orifices 51*a* and the second orifices 51*b* are alternately arranged around the central axis O.

Figure 9A:
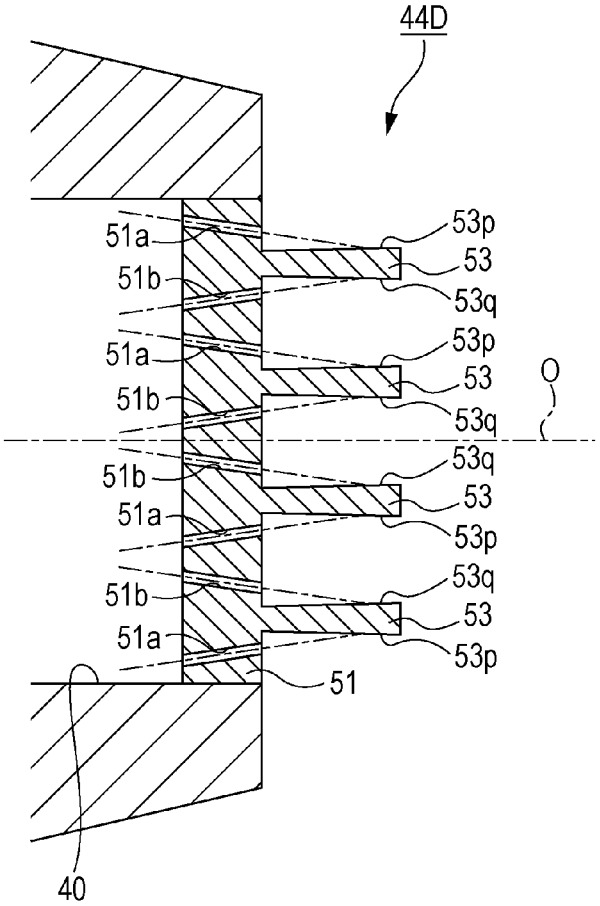
FIG. 9A is a partial enlarged cross-sectional view of an atomization mechanism according to still another variation.
Figure 9B:
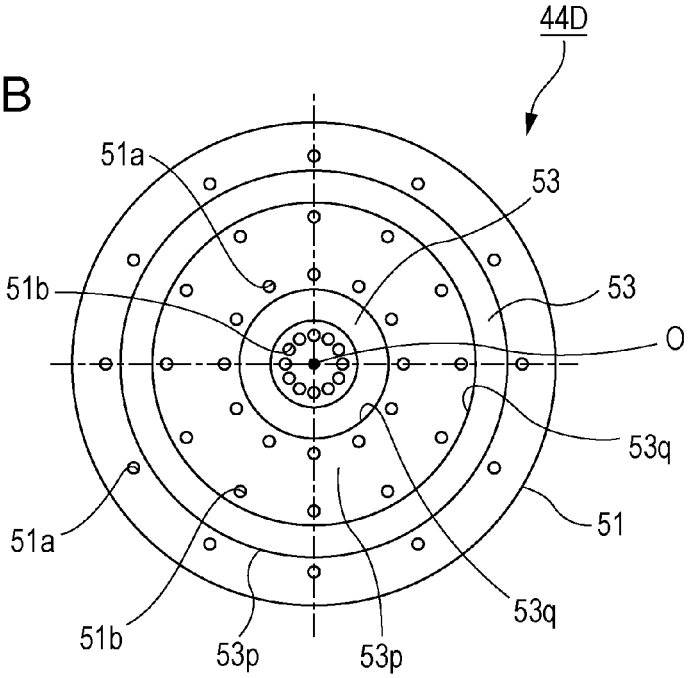
FIG. 9B is a plan view of the atomization mechanism illustrated in FIG. 9A.

As illustrated in FIGS. 9A and 9B, in an atomization mechanism 44D according to still another variation, a plurality of collision plates, each of which is the collision plate 53, are provided and the number of the collision plates 53 is two in the present variation, Specifically, the plurality of collision plates 53 are arranged in directions extending from the central axis O of the ejector 11 toward the inner wall surface 42*p* of the mixer 42. The plurality of orifices 51*a* and 51*b* are arranged on a plurality of virtual circles, which are concentric with one another and are not illustrated. Each collision plate 53 is arranged between the virtual circles next to each other. The tubular collision plates 53 are also concentric with the virtual circles. As described above, each of the first principal surface 53*p* and the second principal surface 53*q* of the collision plate 53 may be a conical surface. The present variation facilitates coping with increase in the flow rate of the ejector 11. Furthermore, the orifices 51*a* and 51*b* that each have a small cross-sectional area can be employed without difficulty.

The first orifices 51*a* and the second orifices 51*b* may be alternately arranged around the central axis O.

In the atomization mechanism 44D, in the collision plate 53 arranged closest to the inner wall surface 42*p* of the mixer 42, the first principal surface 53*p* is positioned nearer to the inner wall surface 42*p* of the mixer 42 than the second principal surface 53*q* is. The first principal surface 53*p* closest to the inner wall surface 42*p* of the mixer 42 satisfies the conditions described with reference to FIGS. 5A and 5B. That is, the extension line L1 of the first principal surface 53*p* intersects the inner wall surface 42*p* of the mixer 42, or the intersection point K2 of the extension line L1 of the first principal surface 53*p* and the opening plane 42*q* on the outlet side of the mixer 42 is positioned in a range from the boundary K to the position away from the boundary K by r/4. According to the above-described configuration, the advantages described with reference to FIGS. 5A and 5B can be obtained even when the plurality of collision plates 53 are provided.

Figure 9C:
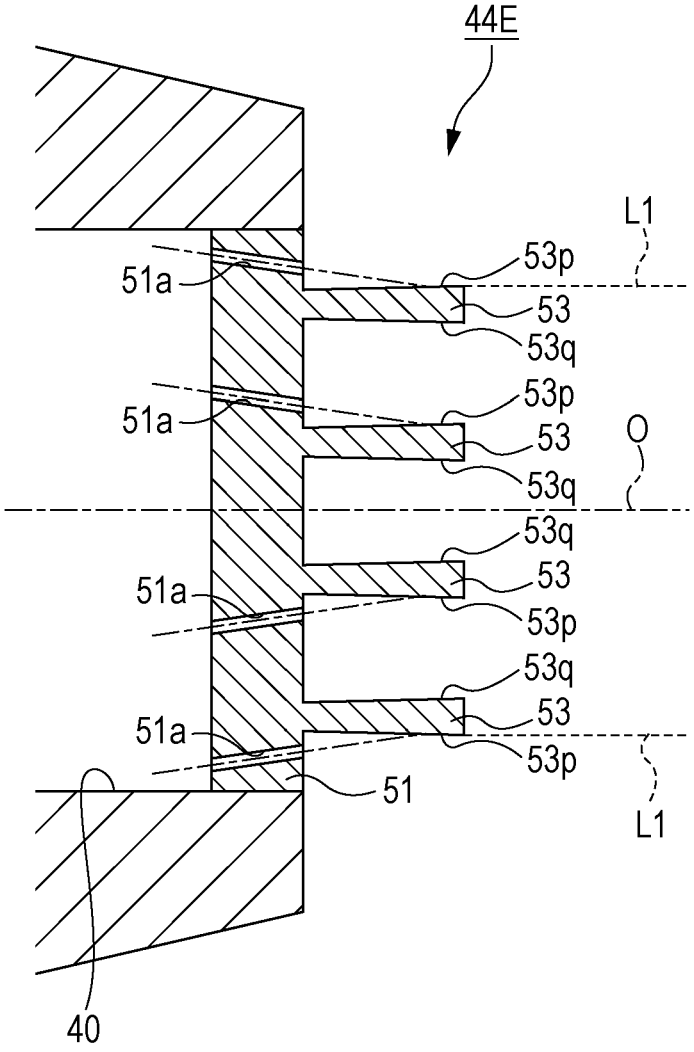
FIG. 9C is a partial enlarged cross-sectional view of an atomization mechanism according to still another variation.

As illustrated in FIG. 9C, in an atomization mechanism 44E according to still another variation, the second orifices 51*b* are omitted from the atomization mechanism 44D described with reference to FIGS. 9A and 9B. That is, when the number of the collision plates 53, the number of the first orifices 51*a*, and the like are suitably set, an even spray flow can be supplied to the mixer 42 without causing jets to collide against two surfaces of each collision plate 53.

Figure 10:
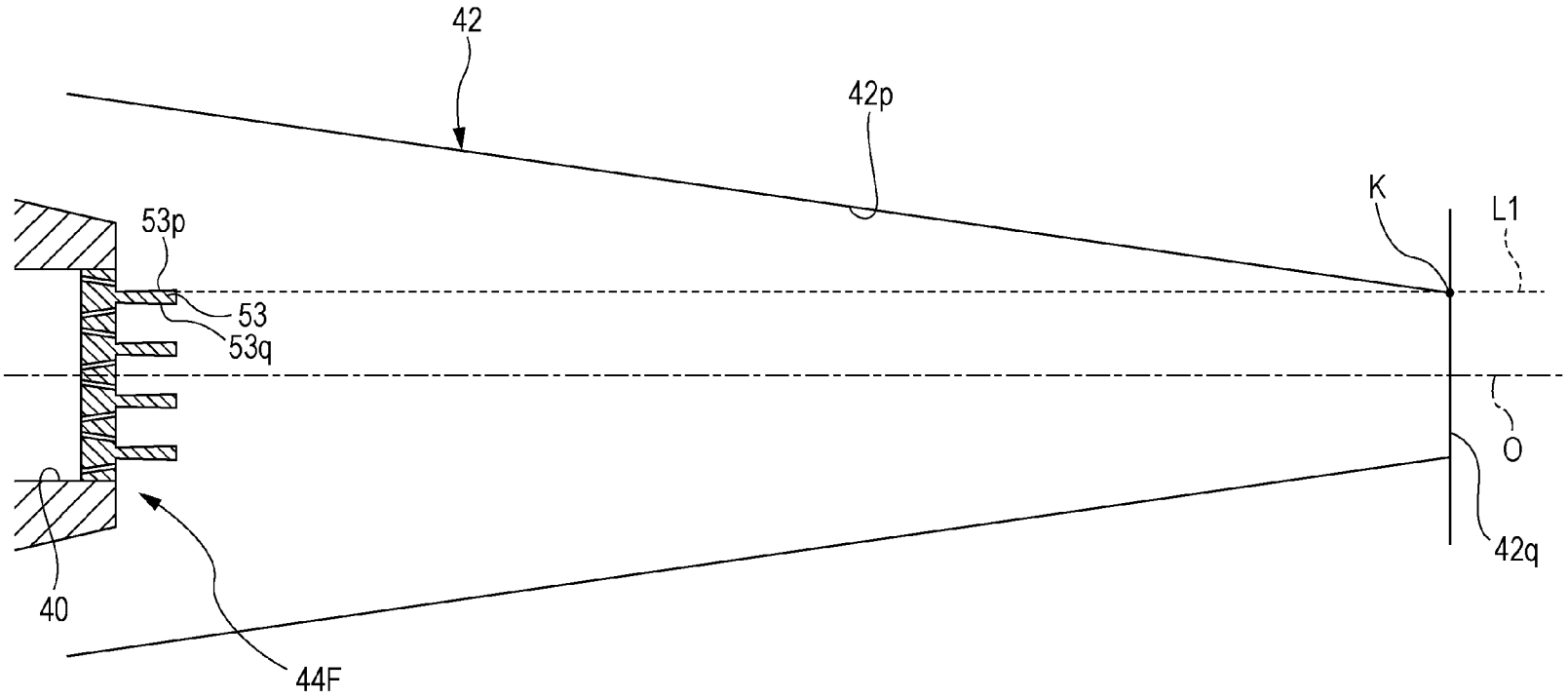
FIG. 10 illustrates the positional relation between collision plates of an atomization mechanism and the inner wall surface of a mixer according to still another variation.

As illustrated in FIG. 10, an atomization mechanism 44F according to still another variation is also provided with the plurality of collision plates 53 and the number of the collision plates 53 is two in the present variation. The first principal surface 53*p* and the second principal surface 53*q* of the collision plate 53 are each a cylindrical surface. That is, the first principal surface 53*p* and the second principal surface 53*q* are parallel to the central axis O. The extension line L1 of the first principal surface 53*p* closest to the inner wall surface 42*p* of the mixer 42 satisfies the conditions described with reference to FIGS. 5A and 5B. In the example illustrated in FIG. 10, the extension line L1 intersects the boundary K. Such a configuration can also bring the above-described advantages.

In the example illustrated in FIG. 10, the cross-sectional area of the mixer 42 gradually decreases toward the opening plane 42*q* on the outlet side. Such a structure can also be desirably employed in the ejector of the present disclosure.

EMBODIMENT 2

Figure 11:
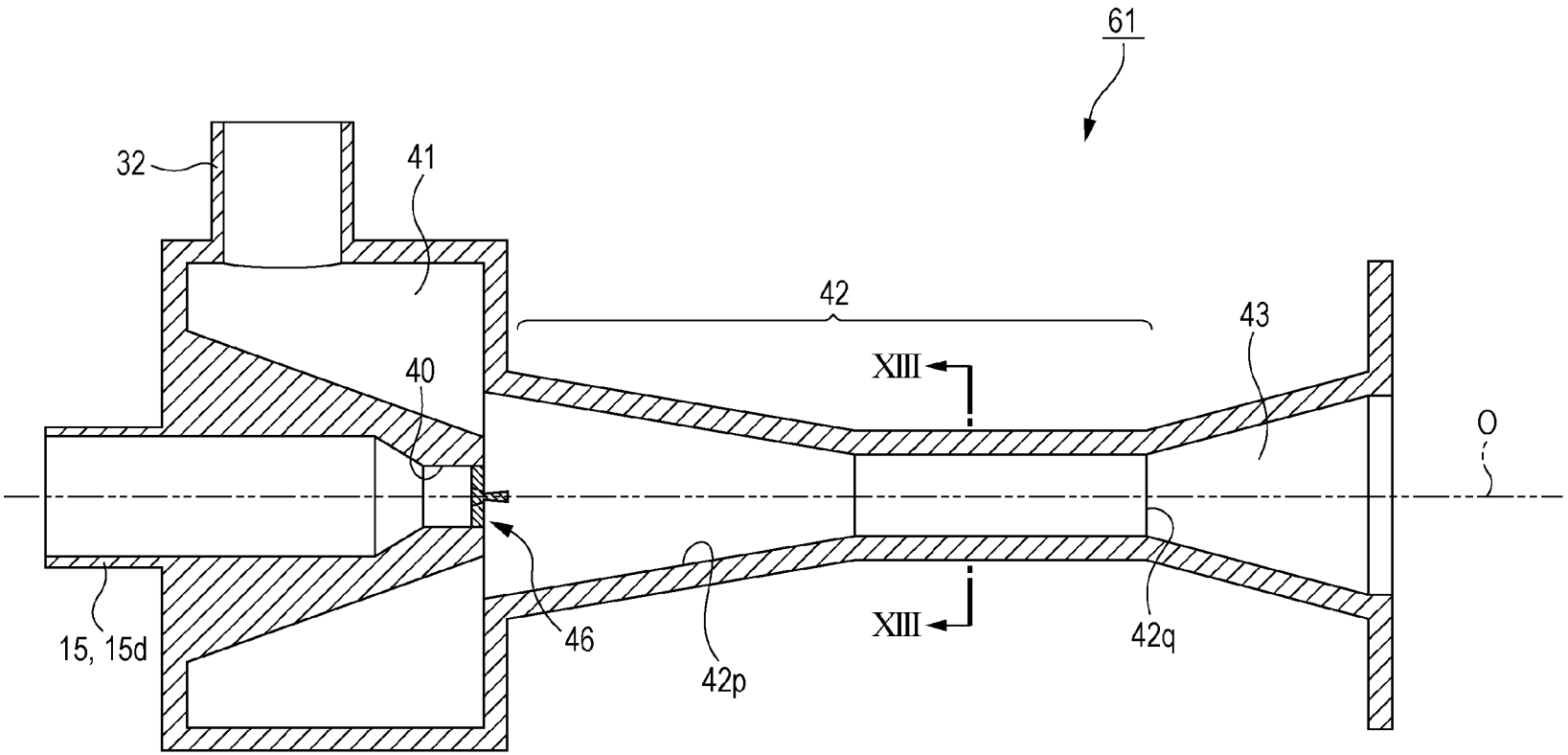
FIG. 11 is a cross-sectional view of an ejector according to Embodiment 2 of the present disclosure.
Figure 12A:
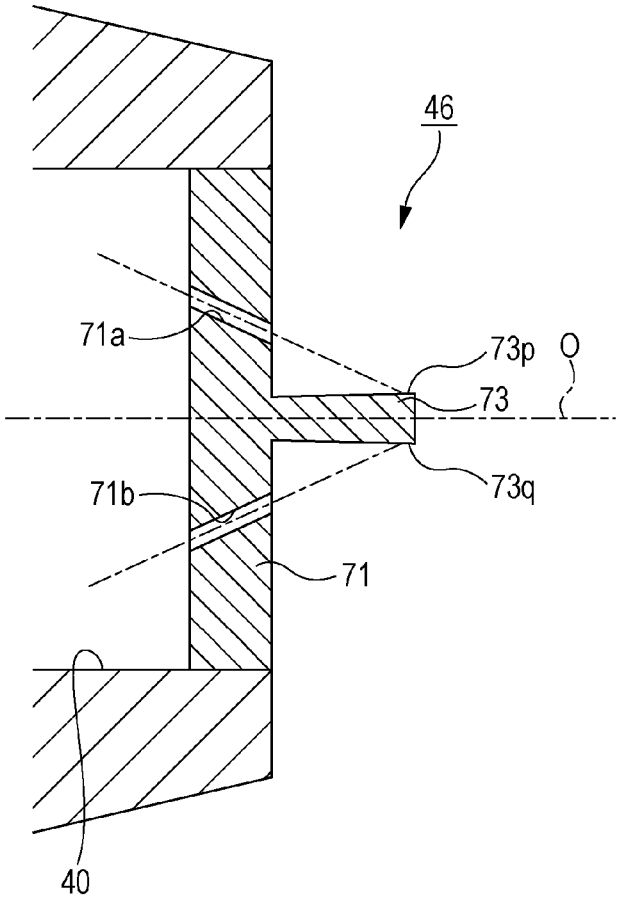
FIG. 12A is a partial enlarged cross-sectional view of an atomization mechanism of the ejector illustrated in FIG. 11.
Figure 12B:
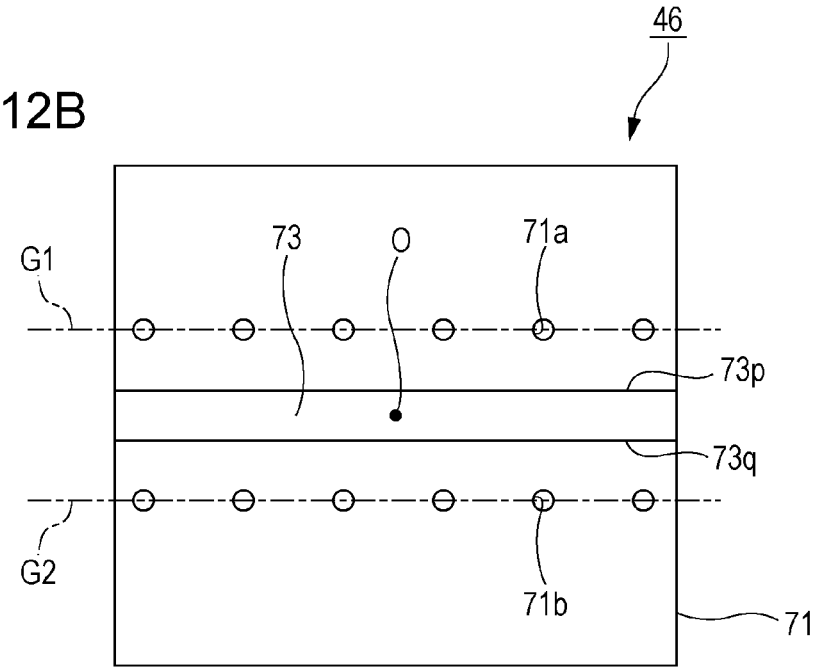
FIG. 12B is a plan view of the atomization mechanism of the ejector illustrated in FIG. 11.

As illustrated in FIGS. 11, 12A, and 12B, in an ejector 61 according to Embodiment 2, an atomization mechanism 46 has a rectangular shape in a plan view. Specifically, the atomization mechanism 46 includes an ejection part 71, which is shaped like a rectangular solid, and a collision plate 73, which is shaped like a flat plate. A plurality of orifices 71*a* and 71*b* are formed through the ejection part 71. The collision plate 73 includes a first principal surface 73*p* and a second principal surface 73*q* as collision surfaces against which the jets ejected from the ejection part 71 collide. Each of the first principal surface 73*p* and the second principal surface 73*q* extends toward the outlet of the ejector 61. The first principal surface 73*p* and the second principal surface 73*q* are each a flat surface. The first principal surface 73*p* is slightly inclined with respect to the second principal surface 73*q*. The plurality of orifices 71*a* and 71*b* include the plurality of first orifices 71*a* and the plurality of second orifices 71*b*. The plurality of first orifices 71*a* are arranged on the side of the first principal surface 73*p* of the collision plate 73. The plurality of second orifices 71*b* are arranged on the side of the second principal surface 73*q* of the collision plate 73. The jet ejected from the first orifice 71*a* collides against the first principal surface 73*p* of the collision plate 73. The jet ejected from the second orifice 71*b* collides against the second principal surface 73*q* of the collision plate 73.

As illustrated in FIG. 12B, the plurality of first orifices 71*a* are arranged at equal intervals along the first principal surface 73*p* of the collision plate 73. That is, when the atomization mechanism 46 is viewed from the outlet side of the ejector 61 as a plane, the plurality of first orifices 71*a* are arranged on a first virtual straight line G1. Similarly, the plurality of second orifices 71*b* are arranged at equal intervals along the second principal surface 73*q* of the collision plate 73. That is, the plurality of second orifices 71*b* are arranged on a second virtual straight line G2 parallel to the first virtual straight line G1. The first principal surface 73*p* is parallel to the first virtual straight line G1 and the second virtual straight line G2. The second principal surface 73*q* is also parallel to the first virtual straight line G1 and the second virtual straight line G2. According to the above-described arrangement, drip caused by the liquid-phase working fluid moving around can be sufficiently suppressed.

The cross-sectional view in FIG. 11 includes the central axis O of the ejector 61 and is perpendicular to the direction in which the orifices 71 a are arranged and/or the direction in which the orifices 71*b* are arranged.

Figure 13:
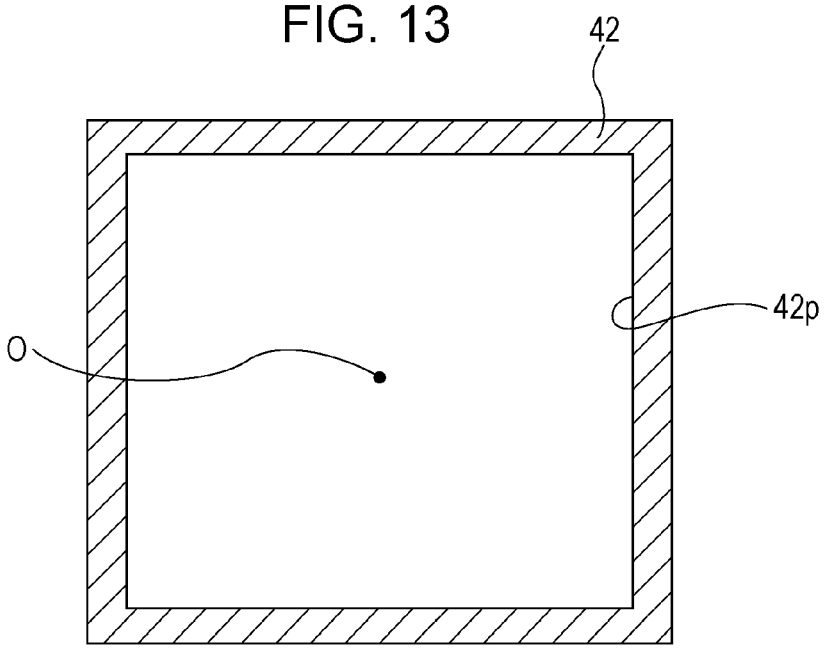
FIG. 13 is a cross-sectional view of a mixer of the ejector illustrated in FIG. 11, which is taken along line XIII-XIII.

As illustrated in FIG. 13, in a cross section perpendicular to the central axis O of the ejector 61, an inner wall surface 42*p* of a mixer 42 indicates a polygon. Specifically, the shape indicated by the inner wall surface 42*p* in the cross section is a rectangle. In the present embodiment, each of the first principal surface 73*p* and the second principal surface 73*q*, which are the collision surfaces, is a flat surface. Accordingly, the spray flow diffuses rectangularly in the mixer 42. Since the cross-sectional shape of the mixer 42 is in similitude relation with the arrangement of the orifices 71*a* and 71*b* in the atomization mechanism 46, in other words, the cross-sectional shape of the mixer 42 is in similitude relation with the diffusion pattern of the spray flow, the volumetric efficiency of the ejector 61 can be enhanced.

Figure 14:
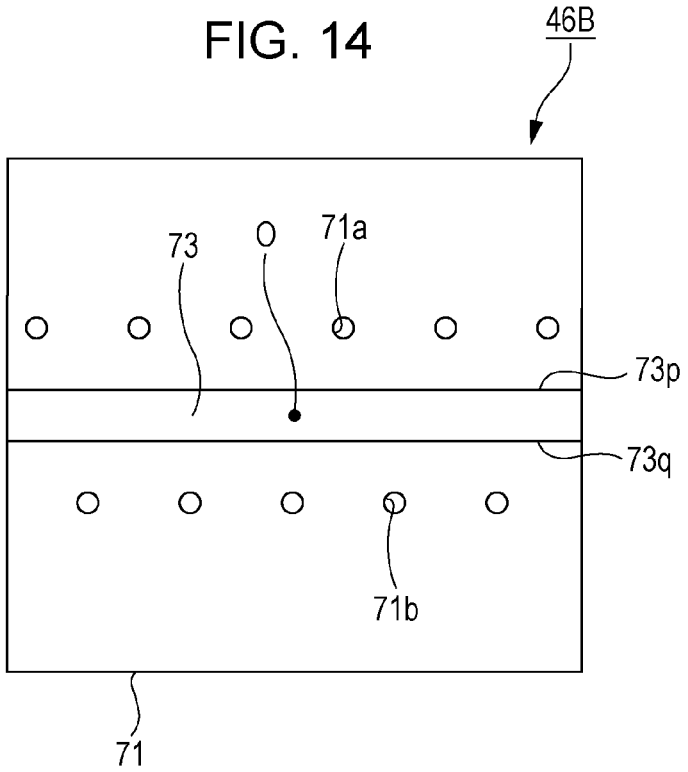
FIG. 14 is a plan view of an atomization mechanism according to still another variation.

As illustrated in FIG. 14, in an atomization mechanism 46B according to a variation, the first orifices 71*a* and the second orifices 71*b* are arranged at alternate positions along the collision plate 73. As described with reference to FIGS. 6 and 7 in the first embodiment, according to the above-described configuration, drip suppression effect can be obtained more sufficiently.

Figure 15:
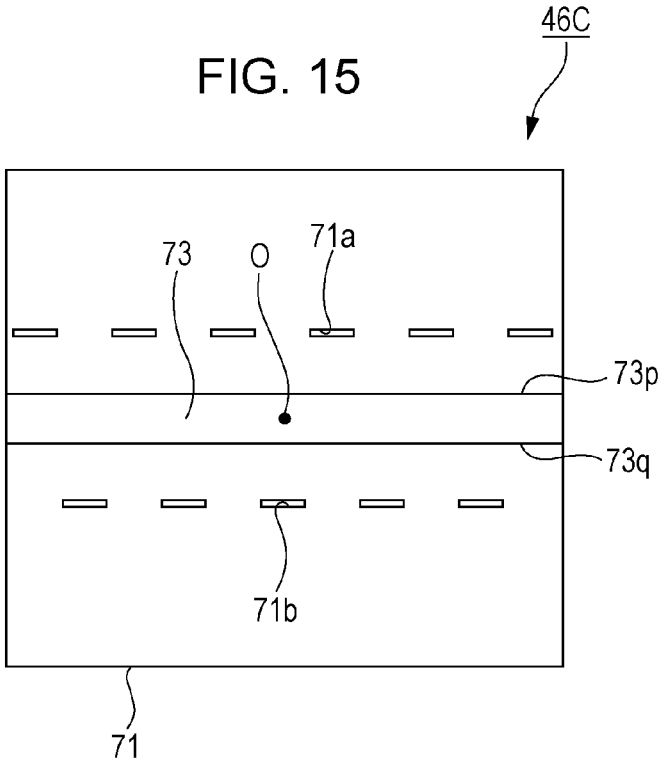
FIG. 15 is a plan view of an atomization mechanism according to still another variation.

As illustrated in FIG. 15, in an atomization mechanism 46C according to another variation, the opening shape of each of the orifices 71*a* and 71*b* is a rectangle. That is, the atomization mechanism 46C includes the orifices 71*a* and 71*b* like slits.

Figure 16:
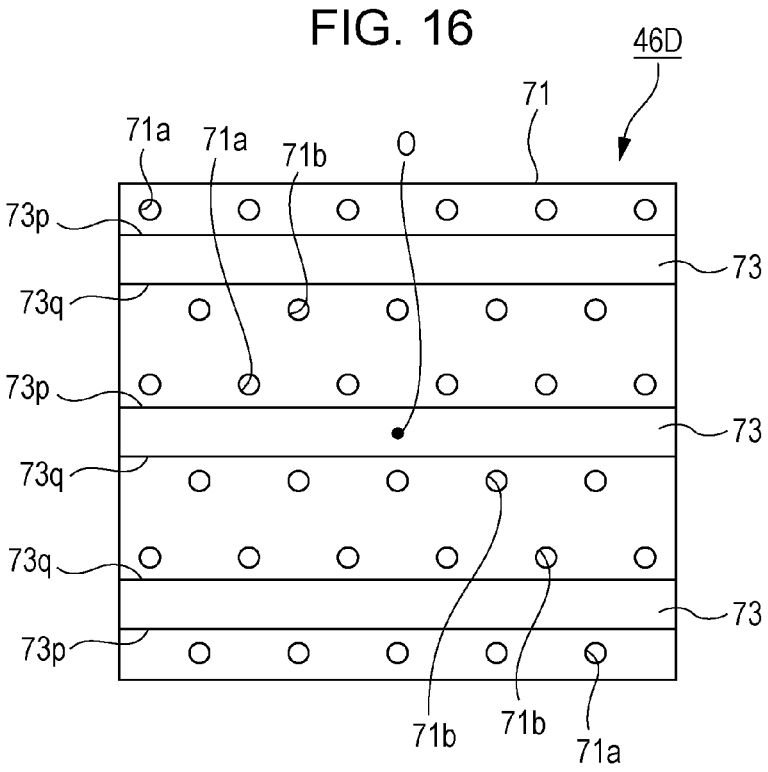
FIG. 16 is a plan view of an atomization mechanism according to still another variation.

As illustrated in FIG. 16, an atomization mechanism 46D according to another variation includes a plurality of collision plates, each of which is the collision plate 73, and the number of the collision plates 73 is three in the present variation. The plurality of orifices 71*a* and 71*b* are arranged on a plurality of virtual straight lines, which are parallel to one another and are not illustrated. Each collision plate 73 is arranged between the virtual straight lines next to each other. The present variation facilitates coping with increase in the flow rate of the ejector 61. Furthermore, the orifices 71*a* and 71*b* that each have a small cross-sectional area can be employed without difficulty.

The configurations in the embodiments and the variations described above may be combined as long as no technical contradiction arises.

EMBODIMENT OF HEAT PUMP APPARATUS USING EJECTOR

Figure 17:
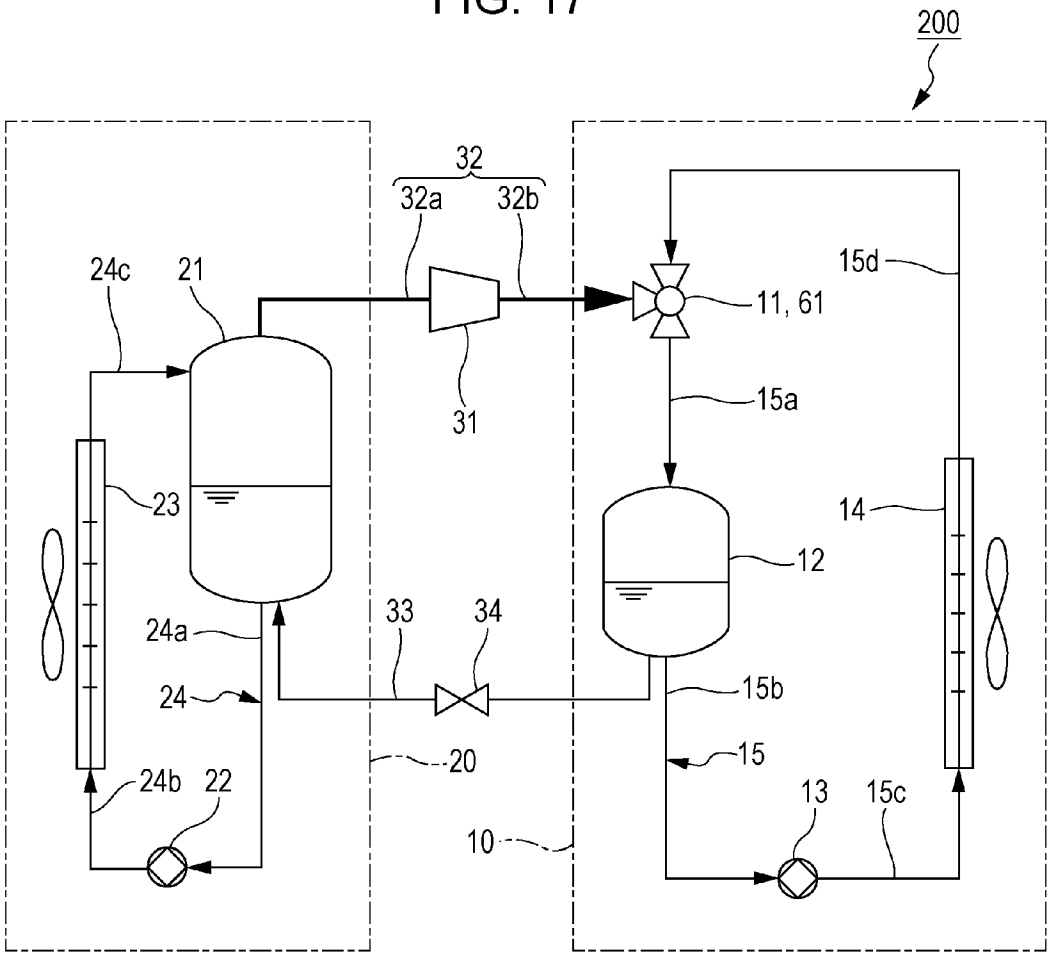
FIG. 17 is a configuration diagram of a heat pump apparatus that uses the ejector.
Figure 18:
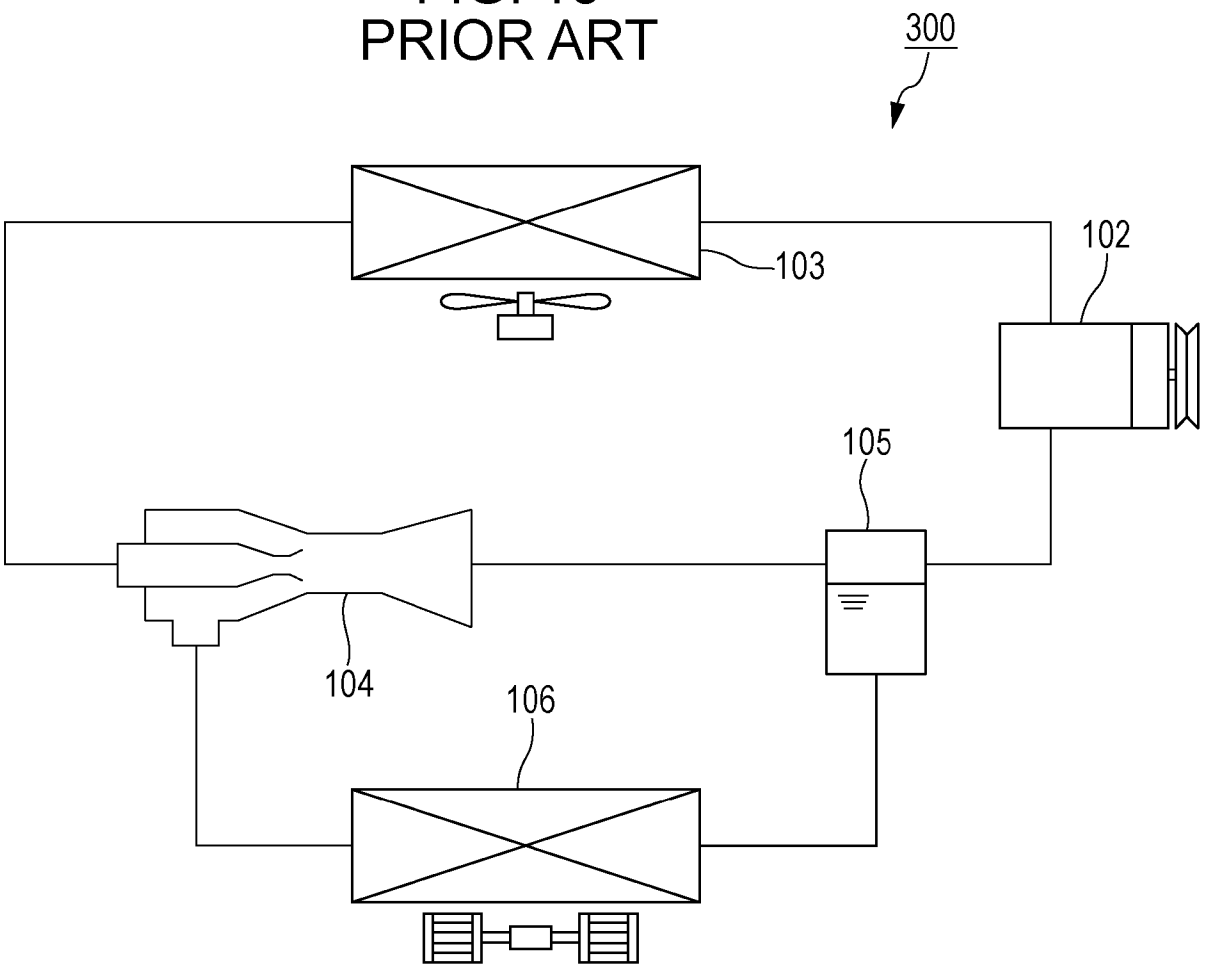
FIG. 18 PRIOR ART
FIG. 18 is a configuration diagram of a conventional refrigeration cycle apparatus.
Figure 19:
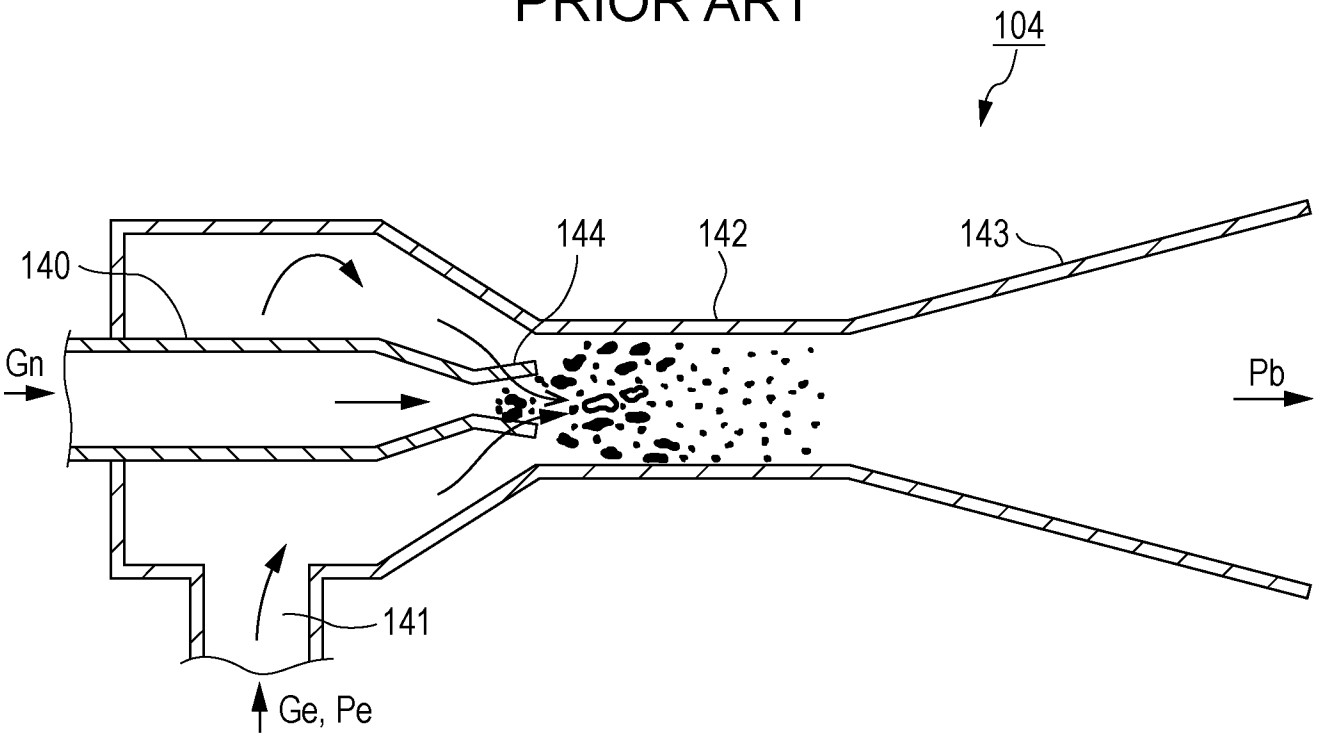
FIG. 19 PRIOR ART
FIG. 19 is a cross-sectional view of an ejector used in the refrigeration cycle apparatus illustrated in FIG. 18.

As illustrated in FIG. 17, a heat pump apparatus 200 of the present embodiment, which is a refrigeration cycle apparatus, includes a first heat exchange unit 10, a second heat exchange unit 20, a compressor 31, and a vapor pathway 32. The first heat exchange unit 10 and the second heat exchange unit 20 constitute a heat-radiation-side circuit and a heat-absorption-side circuit, respectively. The refrigerant vapor generated in the second heat exchange unit 20 passes through the compressor 31 and the vapor pathway 32 and is supplied to the first heat exchange unit 10.

The heat pump apparatus 200 is filled with a refrigerant whose saturated vapor pressure at room temperature, which is 20° C.±15° C. according to JIS Z8703 of Japanese Industrial Standards (JIS), is negative pressure, that is, pressure lower than atmospheric pressure in absolute pressure. An example of such a refrigerant is a refrigerant that includes water, alcohol, or ether as the principal ingredient. During operation of the heat pump apparatus 200, the pressure inside the heat pump apparatus 200 is lower than the atmospheric pressure. The pressure at the inlet of the compressor 31 is, for example, in a range from 0.5 kPaA to 5 kPaA. The pressure at the outlet of the compressor 31 is, for example, in a range from 5 kPaA to 15 kPaA. Another example of the refrigerant usable includes water for preventing freezing or the like as the principal ingredient and includes ethylene glycol, Naiburain (trademark), an inorganic salt, or the like mixed to make up 10% to 40% when converted to mass percentage. The "principal ingredient" represents the ingredient that is included the most at the mass ratio.

The first heat exchange unit 10 includes the ejector 11, a first extractor 12, a first pump 13, and a first heat exchanger 14. The ejector 11, the first extractor 12, the first pump 13, and the first heat exchanger 14 are annularly connected in the named order through pipes 15*a* to 15*d*.

The ejector 11 is connected to the first heat exchanger 14 through the pipe 15*d* and is connected to the compressor 31 through the vapor pathway 32. The ejector 11 is supplied with the refrigerant liquid that flows out from the first heat exchanger 14 as the driving flow and supplied with the refrigerant vapor compressed in the compressor 31 as the suction flow. The ejector 11 generates a refrigerant mixture with a small quality, that is, dryness, and supplies the refrigerant mixture to the first extractor 12. The refrigerant mixture is a refrigerant in a liquid-phase state or a gas-liquid two-phase state, where the quality is very small. The pressure of the refrigerant mixture discharged from the ejector 11 is, for example, higher than the pressure of the refrigerant vapor sucked into the ejector 11 and lower than the pressure of the refrigerant liquid supplied to the ejector 11.

The first extractor 12 receives the refrigerant mixture from the ejector 11 and extracts the refrigerant liquid from the refrigerant mixture. That is, the first extractor 12 serves as a gas-liquid separator, which separates the refrigerant liquid and the refrigerant vapor. Basically, only the refrigerant liquid is taken out from the first extractor 12. The first extractor 12 is made up of, for example, a pressure-resistant container with heat insulating properties. As long as the refrigerant liquid can be extracted, the structure of the first extractor 12 is not particularly limited. The pipes 15*b* to 15*d* constitute a fluid pathway 15, which passes from the first extractor 12 and reaches the ejector 11 through the first heat exchanger 14. The first pump 13 is provided between the liquid outlet of the first extractor 12 and the inlet of the first heat exchanger 14 in the fluid pathway 15. The first pump 13 presses and sends the refrigerant liquid stored in the first extractor 12 to the first heat exchanger 14. The discharge pressure of the first pump 13 is lower than the atmospheric pressure. The first pump 13 is arranged at a position where the available net positive suction head (NPSH), which takes account of the height from the suction port of the first pump 13 to the level of the refrigerant liquid in the first extractor 12, is larger than the required NPSH. The first pump 13 may be arranged between the outlet of the first heat exchanger 14 and the liquid inlet of the ejector 11.

The first heat exchanger 14 is made up of a known heat exchanger, such as a finned tube heat exchanger or a shell and tube heat exchanger. When the heat pump apparatus 200 is an air conditioner that cools air indoors, the first heat exchanger 14 is arranged outdoors and heats outdoor air using the refrigerant liquid.

The second heat exchange unit 20 includes an evaporator 21, a pump 22, which may be referred to as a second pump, and a second heat exchanger 23. The evaporator 21 stores the refrigerant liquid and generates refrigerant vapor to be compressed in the compressor 31 by vaporizing the refrigerant liquid. The evaporator 21, the pump 22, and the second heat exchanger 23 are annularly connected through pipes 24*a* to 24*c*. The evaporator 21 is made up of, for example, a pressure-resistant container with heat insulating properties. The pipes 24*a* to 24*c* constitute a circulation passage 24 in which the refrigerant liquid stored in the evaporator 21 is circulated through the second heat exchanger 23. The pump 22 is provided between the liquid outlet of the evaporator 21 and the inlet of the second heat exchanger 23 in the circulation passage 24. The pump 22 presses and sends the refrigerant liquid stored in the evaporator 21 to the second heat exchanger 23. The discharge pressure of the pump 22 is lower than the atmospheric pressure. The pump 22 is arranged at a position where the available NPSH, which takes account of the height from the suction port of the pump 22 to the level of the refrigerant liquid in the evaporator 21, is larger than the required NPSH.

The second heat exchanger 23 is made up of a known heat exchanger, such as a finned tube heat exchanger or a shell and tube heat exchanger. When the heat pump apparatus 200 is an air conditioner that cools air indoors, the second heat exchanger 23 is arranged indoors and cools indoor air using the refrigerant liquid.

In the present embodiment, the evaporator 21 is a heat exchanger that directly vaporizes the refrigerant liquid inside, which is heated by circulating through the circulation passage 24. The refrigerant liquid stored in the evaporator 21 comes into direct contact with the refrigerant liquid that circulates through the circulation passage 24. That is, part of the refrigerant liquid in the evaporator 21 is heated in the second heat exchanger 23 and used as a heat source that heats the refrigerant liquid in a saturated state. The upstream end of the pipe 24*a* is desirably connected to the lower portion of the evaporator 21. The downstream end of the pipe 24*c* is desirably connected to the middle portion of the evaporator 21. The second heat exchange unit 20 may be structured so that the refrigerant liquid stored in the evaporator 21 is not mixed into another refrigerant liquid that circulates through the circulation passage 24. For example, when the evaporator 21 has a heat exchange structure, such as the structure of the shell and tube heat exchanger, the refrigerant liquid stored in the evaporator 21 can be heated using a heating medium that circulates through the circulation passage 24 to be vaporized. The heating medium for heating the refrigerant liquid stored in the evaporator 21 flows to the second heat exchanger 23.

The vapor pathway 32 includes an upstream portion 32*a* and a downstream portion 32*b*. The compressor 31 is arranged in the vapor pathway 32. The upstream portion 32*a* of the vapor pathway 32 connects the upper portion of the evaporator 21 to the suction port of the compressor 31. The downstream portion 32*b* of the vapor pathway 32 connects the discharge outlet of the compressor 31 to the second nozzle 41 of the ejector 11. The compressor 31 is a cyclone compressor or a positive-displacement compressor. A plurality of compressors may be provided in the vapor pathway 32. The compressor 31 sucks the refrigerant vapor from the evaporator 21 of the second heat exchange unit 20 through the upstream portion 32*a* and compresses the refrigerant vapor. The compressed refrigerant vapor flows through the downstream portion 32*b* and is supplied to the ejector 11.

According to the present embodiment, the temperature and the pressure of the refrigerant are boosted in the ejector 11. Since the work to be performed by the compressor 31 can be reduced, the compression ratio of the compressor 31 can be largely decreased and the efficiency of the heat pump apparatus 200, which is equivalent to or higher than that of a conventional heat pump apparatus, can be achieved. In addition, the heat pump apparatus 200 can be made smaller in size.

The heat pump apparatus 200 is not limited to an air conditioner for air cooling purpose. A passage switcher, such as a four-way valve or a three-way valve, may be provided so that the first heat exchanger 14 functions as a heat-absorbing heat exchanger and the second heat exchanger 23 functions as a heat-radiating heat exchanger. In this case, an air conditioner where a cooling mode and a heating mode are switchable can be obtained. The heat pump apparatus 200 is not limited to an air conditioner and may be another apparatus, such as a chiller or a thermal storage. A heating target of the first heat exchanger 14 and a cooling target of the second heat exchanger 23 may be gas or liquid other than air, A return passage 33 for returning the refrigerant from the first heat exchange unit 10 to the second heat exchange unit 20 may be provided. An expansion mechanism 34, such as a capillary or an expansion valve, is provided in the return passage 33. In the present embodiment, to transfer the refrigerant stored in the first extractor 12 to the evaporator 21, the return passage 33 connects the first extractor 12 and the evaporator 21. Typically, the lower portion of the first extractor 12 and the lower portion of the evaporator 21 are connected through the return passage 33. The refrigerant liquid that flows from the first extractor 12 in the return passage 33 is reduced in pressure in the expansion mechanism 34 and returned to the evaporator 21.

The return passage 33 may branch from any position of the first heat exchange unit 10. For example, the return passage 33 may branch from the pipe 15*a* that connects the ejector 11 and the first extractor 12 or may branch from the upper portion of the first extractor 12. Returning the refrigerant from the first heat exchange unit 10 to the second heat exchange unit 20 may be omitted. For example, the first heat exchange unit 10 may be structured so that a redundant refrigerant can be discharged when necessary, and the second heat exchange unit 20 may be structured so that the refrigerant can be added when necessary.

The ejector and the heat pump apparatus disclosed herein is useful particularly for an air conditioner, such as a home air conditioner or an industrial air conditioner.

What is claimed is:

1. An ejector comprising:

a first nozzle to which a liquid-phase working fluid is supplied;

a second nozzle into which a vapor-phase working fluid is sucked;

an atomization mechanism that is arranged at an end of the first nozzle and atomizes the liquid-phase working fluid without changing a liquid-phase state of the liquid-phase working fluid; and a mixer that mixes the atomized working fluid generated in the atomization mechanism and the vapor-phase working fluid sucked into the second nozzle and generates a fluid mixture, the atomization mechanism including a plurality of orifices and a collision plate against which each of a plurality of jets ejected from the plurality of orifices collides, the collision plate including a first principal surface and a second principal surface as a collision surface against which the jet collides, each of the first principal surface and the second principal surface extending toward an outlet of the ejector, the plurality of orifices including a plurality of first orifices arranged on a side of the first principal surface of the collision plate and a plurality of second orifices arranged on a side of the second principal surface of the collision plate.

2. The ejector according to claim 1, wherein in a cross section including a central axis of the ejector, (a) an extension line of the first principal surface of the collision plate intersects an inner wall surface of the mixer, or (b) when, on an opening plane on an outlet side of the mixer, r represents a distance from the central axis of the ejector to the inner wall surface of the mixer, an intersection point of the extension line of the first principal surface of the collision plate and the opening plane on the outlet side of the mixer is in a range from a boundary between the opening plane on the outlet side of the mixer and the inner wall surface of the mixer to a position away from the boundary by r/4.

3. The ejector according to claim 1, wherein the atomization mechanism includes a plurality of collision plates, each of which is the collision plate.

4. The ejector according to claim 2, wherein a plurality of collision plates, each of which is the collision plate, are provided in a direction from the central axis of the ejector toward the inner wall surface of the mixer, and in the collision plate arranged in a position closest to the inner wall surface of the mixer, the first principal surface is positioned nearer to the inner wall surface of the mixer than the second principal surface is, and the (a) or the (b) is satisfied.

5. The ejector according to claim 1, wherein when the atomization mechanism is viewed from a side of the outlet of the ejector as a plane, the plurality of first orifices are arranged on a first virtual circle and the plurality of second orifices are arranged on a second virtual circle concentric with the first virtual circle.

6. The ejector according to claim 1, wherein the first principal surface and the second principal surface of the collision plate are each a conical surface or a cylindrical surface.

7. The ejector according to claim 1, wherein a plurality of collision plates, each of which is the collision plate, are provided in a direction from the central axis of the ejector toward the inner wall surface of the mixer, when the atomization mechanism is viewed from a side of the outlet of the ejector as a plane, the plurality of orifices are arranged on a plurality of virtual circles concentric with each other, and each of the collision plates is arranged between the virtual circles next to each other.

8. The ejector according to claim 7, wherein the first principal surface and the second principal surface of the collision plate are each a conical surface or a cylindrical surface, the conical surface or the cylindrical surface being concentric with the plurality of virtual circles.

9. The ejector according to claim 1, wherein when the atomization mechanism is viewed from a side of the outlet of the ejector as a plane, the plurality of first orifices are arranged on a first virtual straight line and the plurality of second orifices are arranged on a second virtual straight line parallel to the first virtual straight line.

10. The ejector according to claim 1, wherein the atomization mechanism includes a plurality of collision plates, each of which is the collision plate, when the atomization mechanism is viewed from an outlet side of the mixer as a plane, the plurality of orifices are arranged on a plurality of virtual straight lines parallel to each other, and each of the collision plates is arranged between the virtual straight lines next to each other.

11. The ejector according to claim 1, wherein in a cross section perpendicular to a central axis of the ejector, an inner wall surface of the mixer indicates a circle.

12. The ejector according to claim 1, wherein in a cross section perpendicular to a central axis of the ejector, an inner wall surface of the mixer indicates a polygon.

13. The ejector according to claim 1, wherein the plurality of first orifices and the plurality of second orifices are arranged at alternate positions along the collision plate.

14. The ejector according to claim 1, further comprising:

a diffuser that restores static pressure by reducing velocity of the fluid mixture.

15. An ejector comprising:

a first nozzle to which a liquid-phase working fluid is supplied;

a second nozzle into which a vapor-phase working fluid is sucked;

an atomization mechanism that is arranged at an end of the first nozzle and atomizes the liquid-phase working fluid without changing a liquid-phase state of the liquid-phase working fluid; and a mixer that mixes the atomized working fluid generated in the atomization mechanism and the vapor-phase working fluid sucked into the second nozzle and generates a fluid mixture, the atomization mechanism including a plurality of orifices and a collision plate against which each of a plurality of jets ejected from the plurality of orifices collides, the collision plate including a principal surface as a collision surface against which the jet collides, the principal surface extending toward an outlet of the ejector, wherein in a cross section including a central axis of the ejector, an extension line of the principal surface of the collision plate intersects an inner wall surface of the mixer, or when, on an opening plane on an outlet side of the mixer, r represents a distance from the central axis of the ejector to the inner wall surface of the mixer, an intersection point of the extension line of the principal surface of the collision plate with the opening plane on the outlet side of the mixer is in a range from a boundary between the opening plane on the outlet side of the mixer and the inner wall surface of the mixer to a position away from the boundary by r/4.

16. A heat pump apparatus comprising:

a compressor that compresses refrigerant vapor;

a heat exchanger through which refrigerant liquid flows;

the ejector according to claim 1 that generates a refrigerant mixture using the refrigerant vapor compressed in the compressor and the refrigerant liquid that flows out from the heat exchanger;

an extractor that receives the refrigerant mixture from the ejector and extracts the refrigerant liquid from the refrigerant mixture;

a fluid pathway that passes from the extractor and reaches the ejector through the heat exchanger; and an evaporator that stores the refrigerant liquid and generates the refrigerant vapor to be compressed in the compressor by vaporizing the refrigerant liquid.

17. The heat pump apparatus according to claim 16, wherein pressure of the refrigerant mixture discharged from the ejector is higher than pressure of the refrigerant vapor sucked into the ejector and is lower than pressure of the refrigerant liquid supplied to the ejector.

18. The heat pump apparatus according to claim 16, wherein saturated vapor pressure of a refrigerant at room temperature is negative pressure.

19. The heat pump apparatus according to claim 16, wherein a refrigerant includes water as a principal ingredient.

* * * * *